US008015781B2

(12) United States Patent
Kent

(10) Patent No.: US 8,015,781 B2
(45) Date of Patent: Sep. 13, 2011

(54) BOX LOADER

(75) Inventor: David Max Kent, Kent, WA (US)

(73) Assignee: Seatal Automation Systems LLC., Seatal, WA (US)

( * ) Notice: Subject to any disclaimer, the term of this patent is extended or adjusted under 35 U.S.C. 154(b) by 1054 days.

(21) Appl. No.: 11/371,351

(22) Filed: Mar. 8, 2006

(65) Prior Publication Data

US 2007/0209327 A1 Sep. 13, 2007

(51) Int. Cl.
*B65B 5/10* (2006.01)

(52) U.S. Cl. ..... 53/536; 53/245; 53/255; 53/260

(58) Field of Classification Search ..... 53/531, 53/535–537, 540, 244, 245, 248, 255, 260
See application file for complete search history.

(56) References Cited

U.S. PATENT DOCUMENTS

| | | | | |
|---|---|---|---|---|
| 3,871,288 | A * | 3/1975 | White | 100/2 |
| 4,086,745 | A * | 5/1978 | Caudle | 53/540 |
| 4,098,407 | A * | 7/1978 | Moore | 209/517 |
| 4,104,156 | A * | 8/1978 | Fletcher | 209/521 |
| 4,348,145 | A * | 9/1982 | Marklund et al. | 414/288 |
| 4,617,784 | A | 10/1986 | Golicz et al. | |
| 4,683,708 | A | 8/1987 | Linder | |
| 4,742,920 | A * | 5/1988 | Doherty | 209/517 |
| 4,765,453 | A * | 8/1988 | Bucher | 53/248 |
| 4,765,487 | A * | 8/1988 | Bliss | 53/53 |
| 4,781,011 | A | 11/1988 | Prakken | |
| 4,788,812 | A | 12/1988 | Morita et al. | |
| 4,805,379 | A * | 2/1989 | Leibetseder et al. | 53/245 |
| 5,440,862 | A * | 8/1995 | Sanchez-de-Leon-Rodriguez-Roda | 53/535 |
| 5,701,719 | A * | 12/1997 | Neukam | 53/248 |
| 5,934,480 | A * | 8/1999 | Bailey | 209/517 |
| 6,336,308 | B1 | 1/2002 | Kokkersvold et al. | |
| 6,370,845 | B1 | 4/2002 | Kokkersvold et al. | |
| 6,481,186 | B2 | 11/2002 | Kokkersvold et al. | |

FOREIGN PATENT DOCUMENTS

| | | | |
|---|---|---|---|
| EP | 42199 | A1 * | 12/1981 |
| JP | 05-270513 | A * | 10/1993 |
| JP | 06-156435 | A * | 6/1994 |

OTHER PUBLICATIONS

Letter from attorney representing Delbert Odman, purported inventor of U.S. Appl. No. 12/283,583, "Box Loader," mailed Dec. 18, 2008.
Odman, D., "Box Loader," U.S. Appl. No. 12/283,583, filed Sep. 12, 2008.

* cited by examiner

*Primary Examiner* — Stephen F Gerrity

(57) ABSTRACT

A loader includes a sling for supporting a one or more items. The sling is secured on opposite sides of a loading chamber. The loader also includes a lowering mechanism. The lowering mechanism can lower the sling. The loader includes a release mechanism that secures one or both sides of the sling. After the sling is lowered by the lowering mechanism an adequate distance to place the one or more items close to the receptacle, the release mechanism releases one or both sides of the sling, which places the one or more items in or on a receptacle. The loader includes a take-up mechanism attached to one side of the sling. The take-up mechanism takes up the sling when the opposite side of the sling is released by the release mechanism. The loader is capable of inserting close fitting items into receptacles, such as a stack of trays of produce.

18 Claims, 26 Drawing Sheets

BOX LOADER

FIELD OF THE INVENTION

The present invention is related to loading items and, in particular, to methods and apparatus for loading close fitting items into receptacles.

BACKGROUND

Produce, such as apples, are placed on trays having depressions to retain the produce on the tray. Each filled tray is then placed within a box. In order to conserve material, the outside tray dimensions are closely tailored to the inside box dimensions so that little space is wasted within the box. This also prevents the produce from rattling around within the box and possibly damaging the produce. Currently, the trays have to be stacked manually in the boxes due to the tray's dimensions being so closely matched to the inside dimensions of the box. There are no known devices that can precisely load and stack close fitting trays of produce within a box at a speed and with an acceptable defect rate to replace manual loading. Manually stacking trays within boxes can lead to repetitive strain syndrome and cause back injury.

SUMMARY

In view of the aforementioned problems, embodiments of the present invention provide a method and an apparatus capable of inserting close fitting items into or onto receptacles. For example, a stack of trays of produce, such as apples, can be loaded into boxes. In one embodiment, a loader includes a sling for supporting one or more items to be loaded. The sling is secured on opposite sides of a loading chamber. The loader also includes a lowering mechanism that is in contact with the sling. The lowering mechanism can lower the sling with the one or more items. The loader includes a release mechanism that secures one or both sides of the sling on one or both sides of the loading chamber. After the sling is lowered by the lowering mechanism an adequate distance to place the one or more items close to the receptacle, the release mechanism releases one or both sides of the sling, which places the one or more items in or on a receptacle. The loader includes a take-up mechanism attached to one side of the sling. The take-up mechanism takes up the sling when the opposite side of the sling is released by the release mechanism, thereby loading one or more items into or onto a receptacle.

One embodiment of the present invention is a method for loading items. The method includes forming a sling, placing one or more items on the sling, lowering the sling, releasing one side of the sling, and taking up the sling from the opposite side, thereby loading the one or more items into or onto a receptacle. The present invention can replace manual loading of close fitting items into receptacles, such as trays of produce into boxes.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
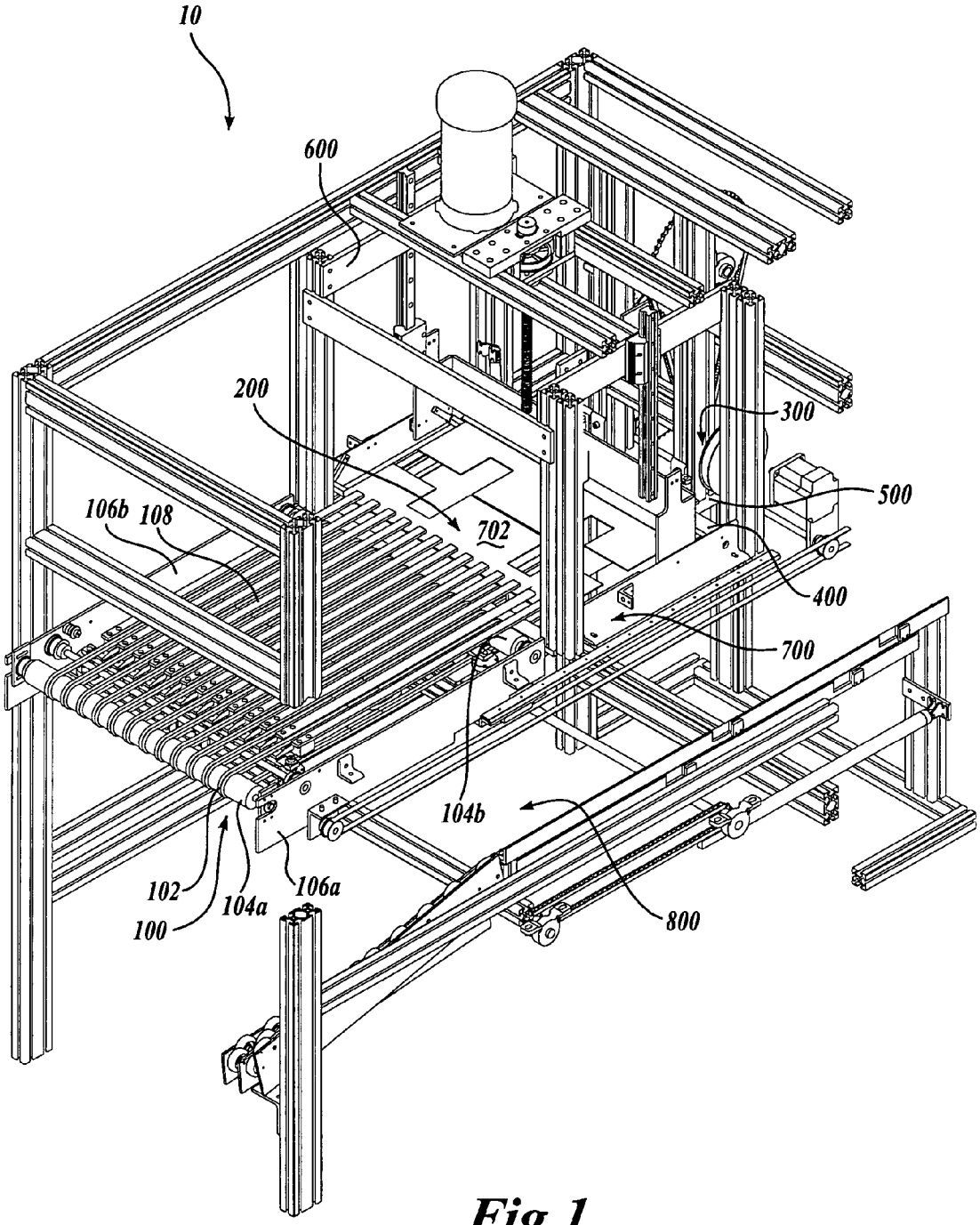
FIG. 1 is an illustration showing a partial view of a loader in accordance with one embodiment of the present invention.

FIG. 1 is an illustration showing a partial view of a loader 10 in accordance with one embodiment of the present invention. Not all components of the loader 10 are being illustrated for clarity and brevity. Directional language used throughout this application is to assist in describing the figures and is not intended to be limiting of the embodiments of the invention.

The loader 10 includes various sub-systems, which in unison act to stack and load an item into or onto a receptacle. The loader 10 includes an infeed conveyor sub-system 100 for conveying items to be stacked and then loaded into a container or receptacle. The loader 10 includes a flap and flipper sub-system 200 for holding items prior to being delivered to a sling sub-system 700. The flap and flipper sub-system 200 is located forward of the infeed conveyor sub-system 100 and in the general area of the loading chamber. The loader 10 includes a take-up mechanism sub-system 300 for holding a strap to be formed into a sling and then for taking up the strap. The take-up mechanism sub-system 300 is located on one side of the loading chamber 702. As will be described in greater detail, one or more slings will be spanned across the loading chamber and the one or more slings will be secured on opposite sides of the loading chamber, thereby holding the items in the loading chamber. The loader 10 includes a release mechanism sub-system 400 for holding and then releasing one or more ends of a sling at one side of the loading chamber, wherein release of the ends thereby places an item that is carried on the sling or slings in or on a receptacle. The loader 10 includes a home setting mechanism sub-system 500 for positioning the ends of one or more slings at a reliable and reproducible location such that the ends of the one or more slings can be gripped by the release mechanism sub-system 400, which then spans the one or more slings across the loading chamber. The loader 10 includes a lowering mechanism sub-system 600 for lowering the one or more slings with items stacked thereon. The loader 10 includes a sling sub-system 700. The sling sub-system 700 includes the one or more slings that span the loading chamber, hold items in the loading chamber, and can be lowered via the use of the lowering mechanism 600. The loader 10 includes a box conveyor sub-system 800 for moving boxes in and out of a loading area that is positioned to receive the items carried on the one or more slings. The sub-systems mentioned above cooperate with each other and may operate sequentially or simultaneously to convey, stack, and load items into or onto a receptacle while under the control of a computer to provide an automated manner of stacking and loading items. An advantage of one embodiment of the invention is the ability to load close fitting items, such as trays of produce, into a box with inside dimensions close to the tray dimensions.

Figure 2:
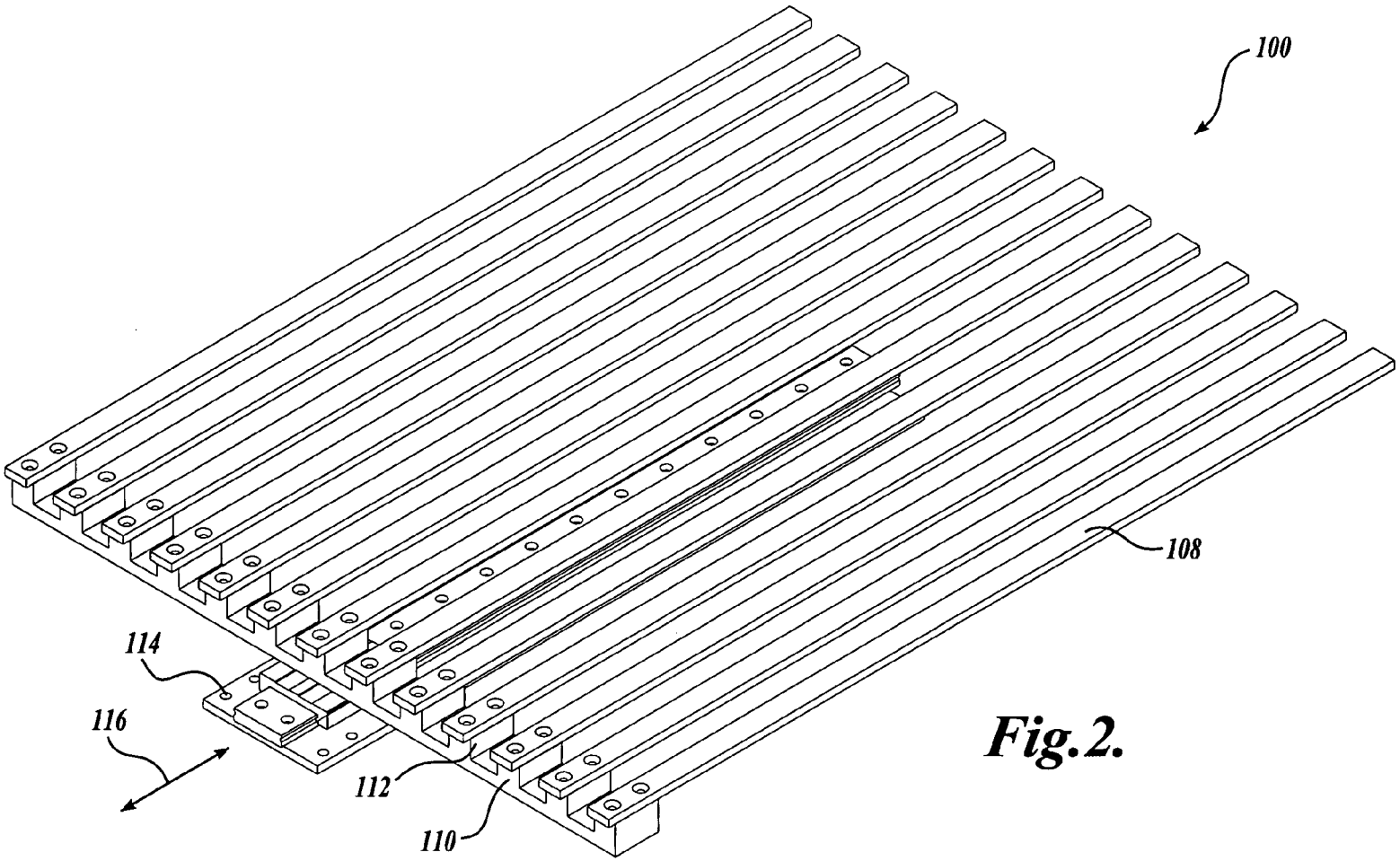
FIG. 2 is an illustration showing a partial view of an infeed conveyor sub-system in accordance with one embodiment of the present invention.

Referring to FIG. 1, the infeed conveyor sub-system 100 includes a plurality of bands 102 stretched across first and second elongated rollers 104*a* and 104*b*. Rollers 104*a* and 104*b* transversely span two parallel side beams 106*a* and 106*b*. Grooves are made in the circumference of the rollers 104*a* and 104*b* such that the bands 102 rest within the grooves. The rollers 104*a* and 104*b* are held in place by a shaft disposed within the center of each of the rollers 104*a* and 104*b*. At least one of the rollers 104*a* or 104*b* is connected to a drive mechanism that drives the roller, and thus the bands 102, to advance an item when in contact with the top surfaces of the bands 102. A plurality of slats 108 is interspersed between the individual bands 102. Referring momentarily to FIG. 2, the plurality of slats 108 are connected to a common cross member 110. Cross member 110 has raised individual ridges 112 to which each slat 108 is connected and which allows room for the bands 102 between the slats 108. At the opposite end to the cross member 110, the slats 108 are not connected to one another. Cross member 110 is further connected to a foot plate 114. Foot plate 114 is ultimately connected to a driver (not shown). Driver (not shown) can be a stepper motor, for example. Foot plate 114 is allowed to translate forwards and backwards in a linear motion, as indicated by the double-headed arrow 116. Foot plate 114 moves linearly along a corresponding guide mounted on the frame of the loader 10. Timing of the linear horizontal motion of the slats 108 is controlled by software residing on a computer system, which will be described in greater detail below. Slats 108 normally stand proud above the level of the bands 102, and the slats 108 can translate forwards while in this position to deposit an item into the loading chamber. Slats 108 can then be retracted backwards. In this manner, any item resting atop the slats 108, or carrying platform, will be carried along with the movement of the slats 108 and be deposited to the loading chamber. A loading chamber as used in this application defines an area of the loader 10, generally, where items are delivered to be supported by one or more slings.

Returning to FIG. 1, the bands 102 are aligned with and positioned above a second set of slats (not shown). The second set of slats can be raised to contact the upper length of the bands 102 from the bottom of the bands 102, thereby pushing the upper length of the bands 102 upwards to rise above the level of the slats 108. Therefore, as can be appreciated, by raising and lowering the second set of slats (not shown), items resting atop the slats 108 can be urged to come in contact with the bands 102 and thereby move accordingly with the motion of the bands 102 and be brought forward to be aligned directly above the slats 108. A trip sensor (not shown) can be positioned along the infeed conveyor sub-system 100 just before the slats 108, indicating an item has arrived and is ready for loading if certain conditions are satisfied. A second trip sensor (not shown) can be positioned in the general area of the slats 108 to indicate that an item has reached the slats 108 and can be subsequently loaded, again, if certain conditions are satisfied. Trip sensors (not shown) send signals to a computer system as input to a software program to determine the appropriate action to take. If certain conditions are satisfied, as will be described below, the slats 108 carry an item to the loading chamber to the flap and flipper sub-system 200 or to a stack of items.

Figure 3:
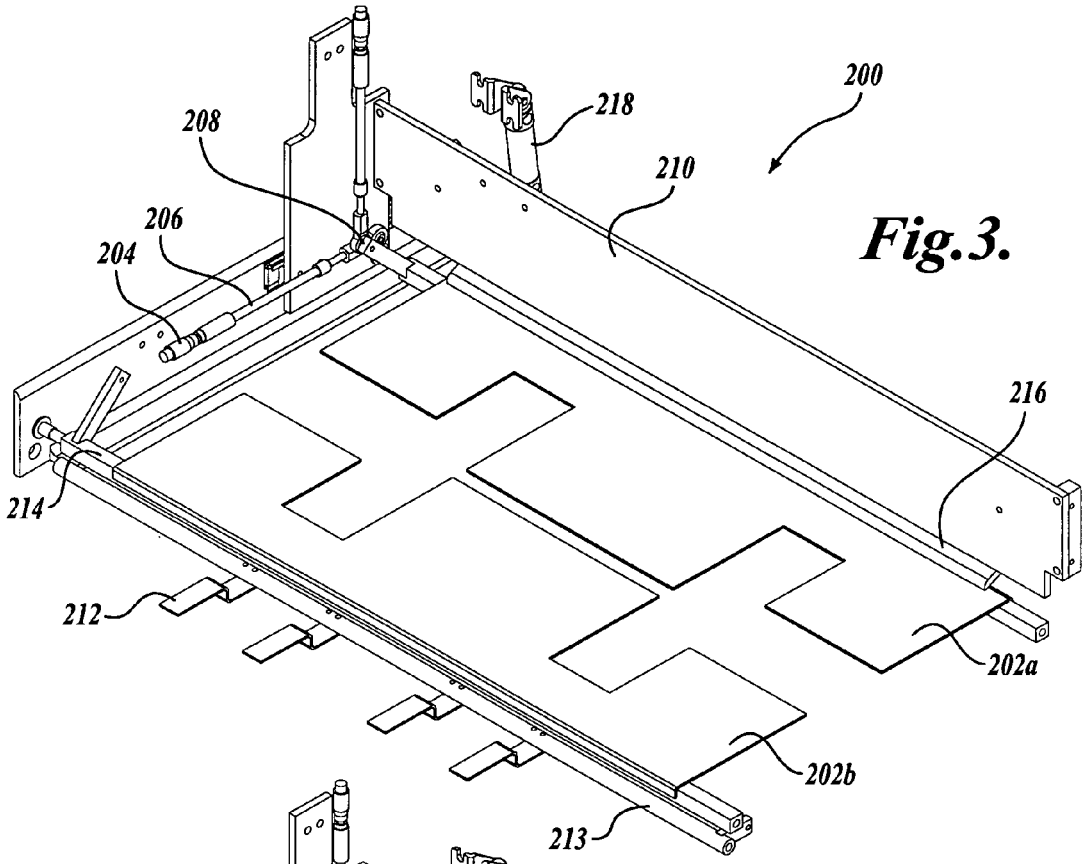
FIG. 3 is an illustration showing a partial view of a flap and flipper sub-system in accordance with one embodiment of the present invention.
Figure 4:
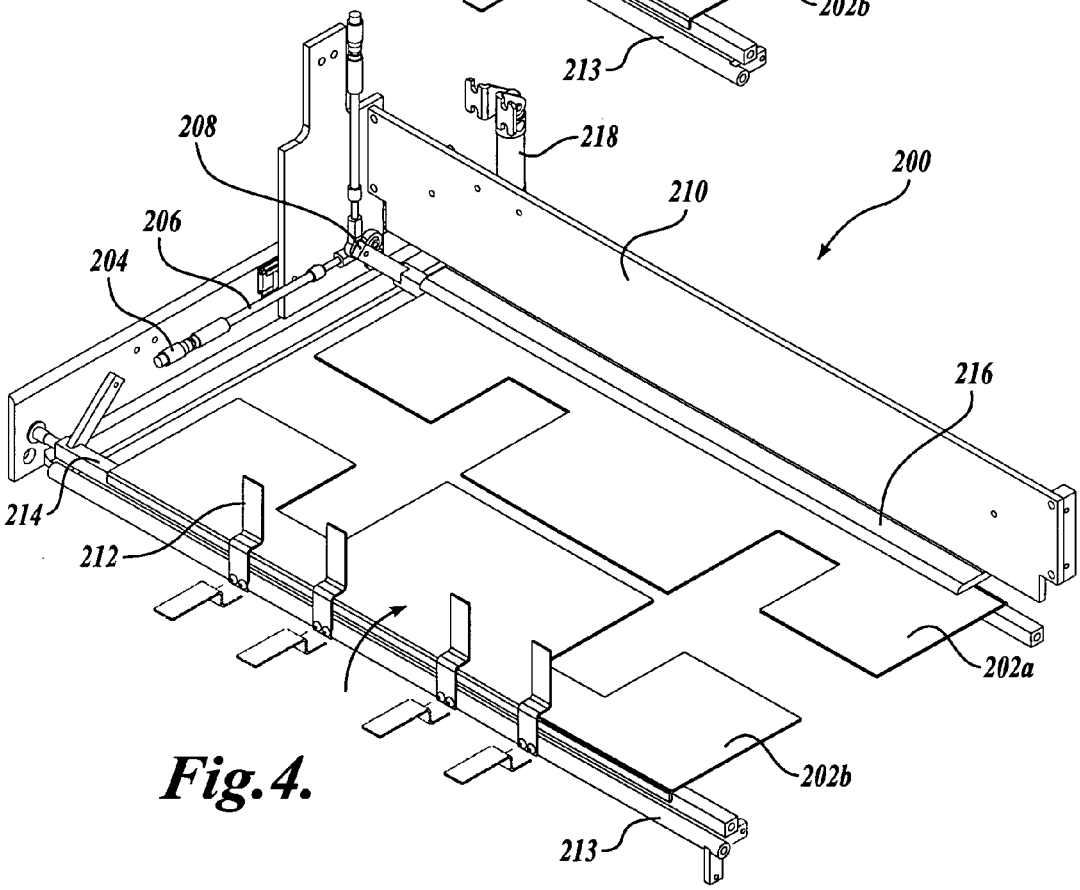
FIG. 4 is an illustration showing a partial view of a flap and flipper sub-system in accordance with one embodiment of the present invention.

Referring to FIGS. 3 and 4, a flap and flipper sub-system 200 is partially illustrated. In FIG. 3, the flap and flipper sub-system 200 is shown with flaps 202*a* and 202*b* in a horizontal position. The flaps 202*a* and 202*b* are in the area of the loading chamber 702 such that the bottom item (first item) of a stack is deposited by the slats 108 on top of the flaps 202*a* and 202*b*. Flaps 202*a* and 202*b* are each connected to a turning rod 208 and 214, respectively. Turning rod 208 is connected to an actuator 204 through a linear arm 206. The linear arm 206 is connected to the turning rod 208 off center of the turning rod 208 to apply a turning torque on the turning rod 208. When arm 206 is actuated linearly, linear arm 206 causes turning rod 208 to rotate 90°, thereby, rotating the flap 202*a* vertically downwards. Simultaneously, the flap 202*b* is linked to the turning rod 208 such that flap 202*b* is also rotated 90° in unison with flap 202*a* to turn to the downward vertical position. Actuator 204 that operates the turning of the turning rod 208 is programmed to operate according to a programmed sequence of events. The flap and flipper sub-system 200 includes a front stop plate 210. Front stop plate 210 prevents items from moving forward and out of alignment with flaps 202*a* and 202*b*, which act as "bomb bay" style doors to place an item onto a sling, as will be described below. Front stop plate 210 can be adjusted forwards and backwards. Front stop plate 210 can be moved forwards and backwards to vary the dimension of the area for holding items. Thus, the loader 10 can be configured to accommodate items of varying sizes. The flap and flipper sub-system 200 includes a back end set of flippers 212. Flippers 212 are connected to a turning rod 213. Turning rod 213 is further connected to an actuator (not shown), which causes turning rod 213 to rotate the set of flippers 212 from horizontal to vertical to stand higher than the top surfaces of the flaps 202*a* and 202*b*. Back end set of flippers 212 is timed to actuate when an item is delivered onto the flaps 202*a* and 202*b*. After delivery of an item on the top surfaces of flaps 202*a* and 202*b*, the back end set of flippers 212 is actuated from a horizontal position, as shown in FIG. 3, to the vertical position, as shown in FIG. 4. Back end set of flippers 212 is positioned horizontally when awaiting an item to be delivered onto flaps 202*a* and 202*b*. Front stop plate 210 prevents items being delivered on the top surfaces of flaps 202*a* and 202*b* by slats 108 from being carried past the drop area. To deliver an item to flaps 202*a* and 202*b*, the slats 108 carry the item above flaps 202*a* and 202*b*. Then, the back end set of flippers 212 is positioned horizontally. This prevents items from being carried backwards with the retraction of the slats 108. The set of flippers 212 holds items in position while the slats 108 are being retracted from underneath the item. A support ledge 216 runs along the front edge of the front stop plate 210. The support ledge 216 holds the front edge of the item to be loaded so that the item does not move out of alignment when the slats 108 are retracted backwards and from underneath the item. The support ledge 216 is shown lowered in FIG. 3, but is set horizontal when flippers 212 are vertical in FIG. 4. Turning rod 213 connected to set of flippers 212 is connected by a linkage to an actuator (not shown), which is controlled by software to operate at a predetermined time and in a predetermined sequence as will be described below. The purpose for the back end set of flippers 212 is to generally align the item squarely on the top surfaces of the flaps 202*a* and 202*b*, such that when flaps 202*a* and 202*b* are actuated vertically, the item resting thereon will be dropped onto one or more slings without catching on edges.

Figure 5:
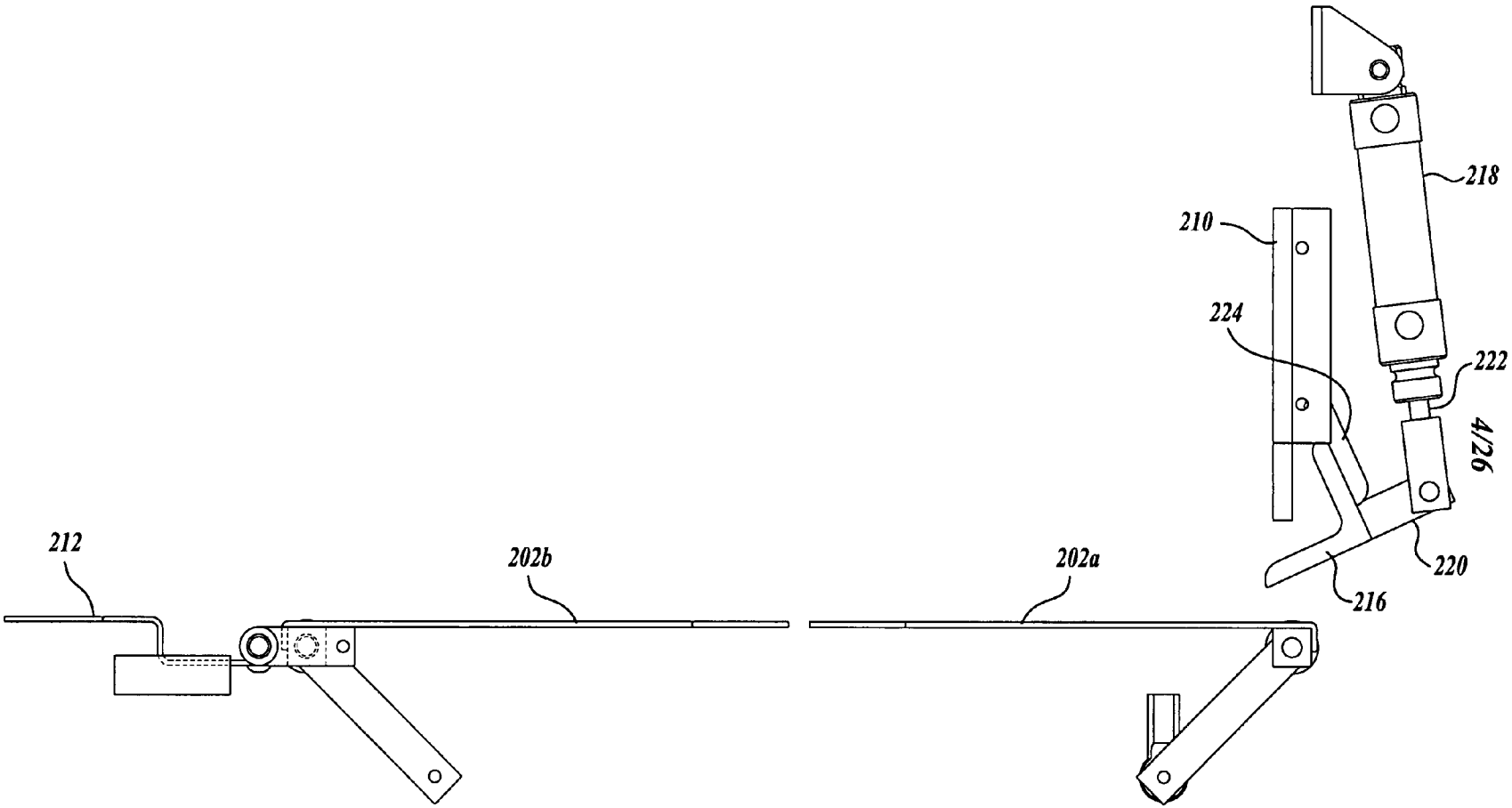
FIG. 5 is a cross section illustration of FIG. 3.
Figure 6:
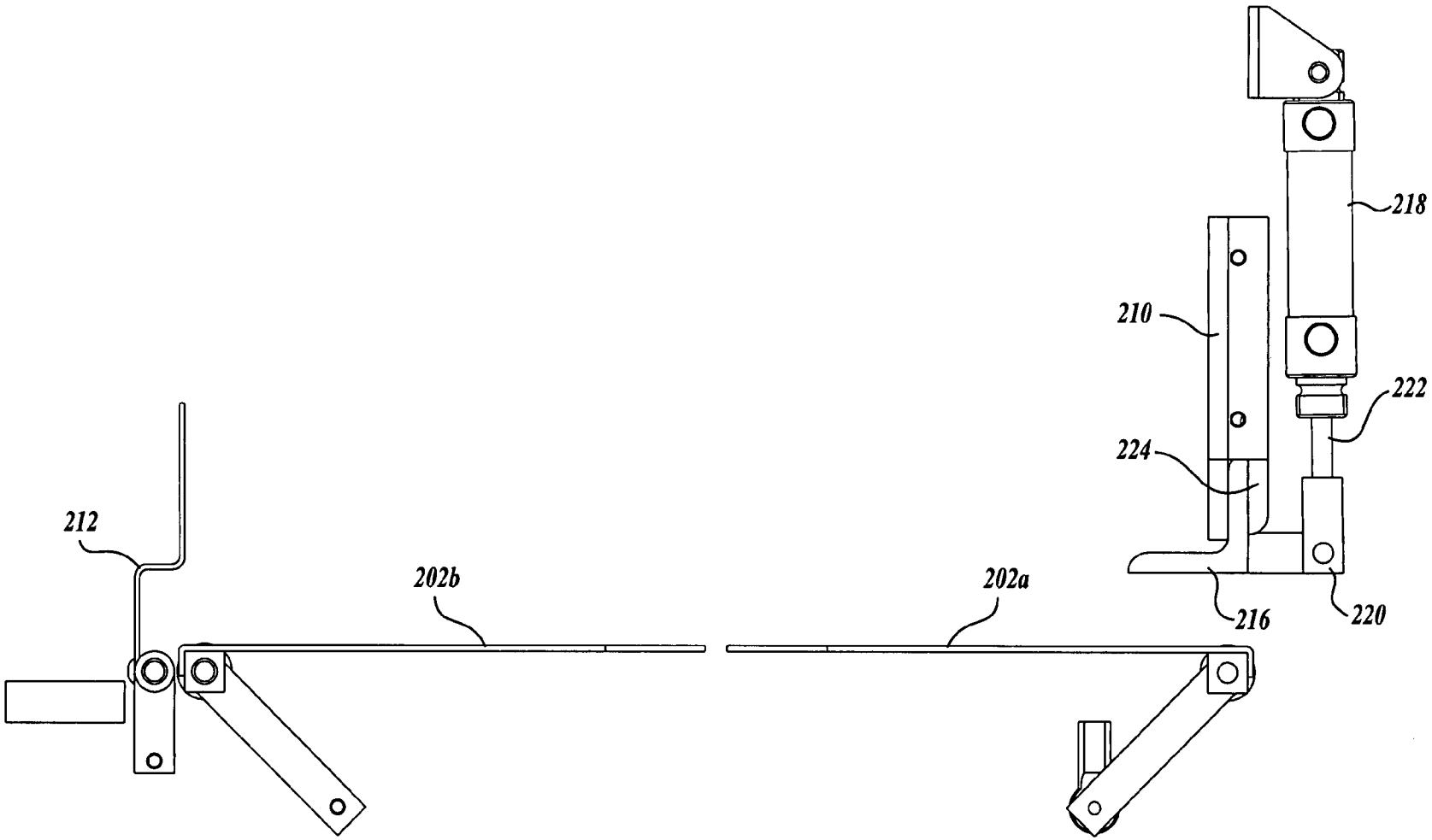
FIG. 6 is a cross section illustration of FIG. 4.

FIG. 5 is a cross section illustration partially showing the flap and flipper sub-system 200 of FIG. 3. FIG. 5 is provided to show the detail of the support ledge 216. In both FIGS. 3 and 5, the support ledge 216 is retracted out of the way so as not to interfere with the delivery of an item into the loading chamber above the first and the second flaps 202*a* and 202*b*. FIG. 5 shows the set of flippers 212 in a horizontal position. The first and second flaps 202*a* and 202*b* are also horizontal, and the support ledge 216 is retracted in preparation to receive an item being carried by the slats 108. The support ledge 216 is connected to a pivoting arm 224, which permits support ledge 216 to travel in a swinging motion. The profile of support ledge 216 includes an "L"-shaped member that runs the length of the front stop plate 210. The lower section of support ledge 216 swings in and out of position from underneath the front stop plate 210. The rear of the support ledge 216 is connected to flexing arm 220. Flexing arm 220 is further connected to an actuator 218 via the linear arm 222. Actuator 218 may be programmed to operate in a specific sequence and according to a predetermined sequence of events. Actuator 218 may be a pneumatic actuator or a voice coil actuator. Linear arm 222 engages the flexing arm 220, such that extension of linear arm 222 pushes the flexing arm 220 down. Because support ledge 216 swings on the pivoting arm 224, the downward push by actuator 218 on the flexing arm 220 causes the support ledge 216 to pivot in a circular arc thereby coming to rest as shown in FIG. 6. FIG. 6 shows support ledge 216 has been rotated so that a horizontal support ledge is formed directly beneath the front stop plate 210. Support ledge 216 is able to support the front side of an item thereon, such that retraction of slats 108 will not cause the item to be shifted out of alignment when the slats 108 are retracted. As seen in FIG. 6, the set of flippers 212 is also set vertically to cooperate with support ledge 216 in maintaining the item in alignment during retraction of the slats 108. Actuator 218 can be timed to operate substantially simultaneously with or sequentially with the operation of the set of flippers 212.

Returning to FIG. 1, the loader 10 includes a take-up mechanism sub-system 300 generally positioned on one side of the loading chamber 702 and behind the flap and flipper sub-system 200. Take-up mechanism sub-system 300 holds one or more spooled straps, which are unwound to form one or more slings and later wound and, in so doing, the loader 10 places an item into or onto a receptacle. The loader 10 can have any number of slings. In the embodiment described, two (2) slings are used to hold items. Moreover, other embodiments may have fewer or additional slings. A sling is used to hold and support an item. The sling can slowly lower the item while being supported on the sling. Then, the end of the sling can be released and taken-up, thereby placing the item into or onto a receptacle.

Figure 7:
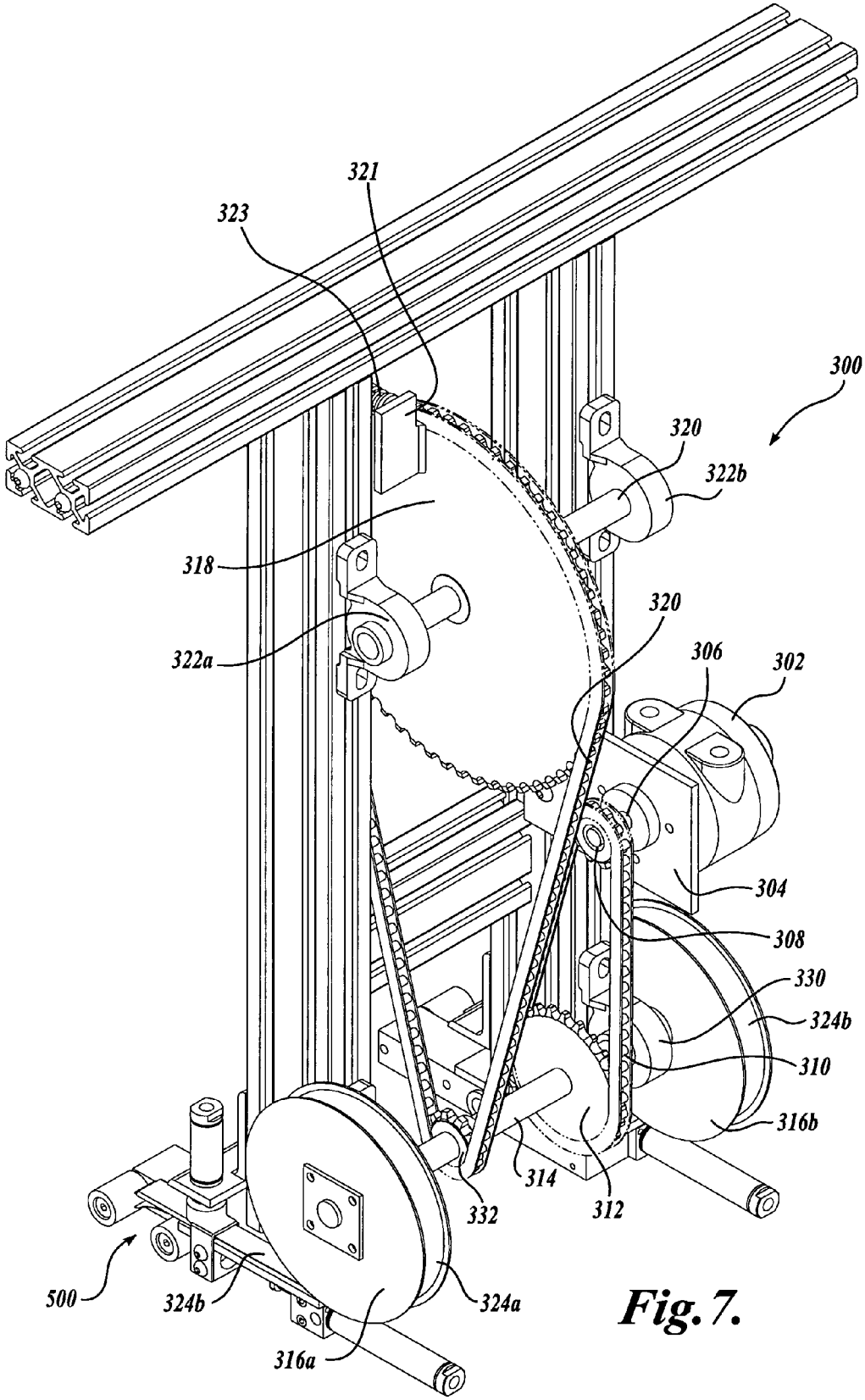
FIG. 7 is an illustration showing a partial view of a take-up mechanism sub-system in accordance with one embodiment of the present invention.

Referring to FIG. 7, the take-up mechanism sub-system 300 is illustrated in greater detail, although some components have been omitted for brevity. Take-up mechanism 300 sub-system includes an air motor 302 supported by a motor mount 304. Motor 302 is provided with start/stop capabilities remotely controlled by a software program, which is programmed to operate at a predetermined time and in a predetermined sequence. Motor 302 includes a motor shaft 306 to supply a rotating torque. Motor shaft 306 is connected to a small diameter drive sprocket 308. Drive sprocket 308 is connected to a torque increasing sprocket 312 via the chain link belt 310. Torque increasing sprocket 312 is mounted on a transverse shaft 114. Shaft 114 is mounted to the frame via roller bearing 330 and another bearing (not shown). The ends of the shaft 314 are connected to winding reels 316*a* and 316*b*. As will be described further below, winding reels 316*a* and 316*b* each carry a flexible strap 324*a* and 324*b*, respectively, which can be paid out and taken up, in accordance with the rotation of the winding reels 316*a* and 316*b*. Shaft 314 has a gear increasing sprocket 332 fixed on the shaft 314. Gear increasing sprocket 332 is connected to a second gear decreasing sprocket 318 via a second chain link belt 320. Second gear decreasing sprocket 318 is connected to a shaft 320. Shaft 320 is mounted on a pair of bearings 322*a* and 322*b*. The gear decreasing sprocket 318 on the shaft 320 has a weldment 321 that contacts a shock absorber 323, such as a coil spring. The location of the weldment 321 dictates the maximum degree of revolution that the winding reels 316*a* and 316*b* will make during the take-up process. Shaft 320 can be connected to drive other sub-systems that synchronize the movement with the winding reels 316*a* and 316*b*. For example, shaft 320 can be connected to the sling release mechanism sub-system 400 that will pull on straps 324*a* and 324*b* as the winding reels 316*a* and 316*b* pay out the straps 324*a* and 324*b* under a braking force that tensions the straps 324*a* and 324*b* as they are being paid out. By connecting the release mechanism sub-system 400 to the shaft 320, the rotation of the winding reels 316*a* and 316*b* can be accurately synchronized with the movement of the release mechanism 400. Straps 324*a* and 324*b* are wound on winding reels 316*a* and 316*b*, respectively. One end of the straps 324*a* and 324*b* is anchored to the winding reels 324*a* and 324*b*. The opposite end of each of the straps 324*a* and 324*b* is guided to a known, reliable and reproducible location by home setting mechanism sub-system 500. Home setting mechanism sub-system 500 positions the ends of the straps 324*a* and 324*b* at the known reliable and reproducible location in preparation for being gripped by the release mechanism sub-system 400.

Returning to FIG. 1, the release mechanism sub-system 400 has been moved in close proximity in relation to the take-up mechanism 300 to clamp the ends of the straps 324*a* and 324*b*. Release mechanism sub-system 400 is for grasping the ends of the straps 324*a* and 324*b* that are not anchored to the winding reels 316*a* and 316*b*. Release mechanism sub-system pulls straps 324*a* and 324*b* over a first and second set of stationary rollers, which will be described in more detail below, and then once the loading of items is completed, the release mechanism sub-system 400 releases the ends of the straps 324*a* and 324*b* to place the items into or onto a receptacle. Release mechanism sub-system 400 moves linearly back and forth from a home position to the left (i.e., forward) of the loading chamber 702 to the take-up mechanism sub-system 300 on the opposite, rear side of the loading chamber 702, and then back home again, thereby paying out the straps 324*a* and 324*b* and creating a pair of slings that span the loading chamber 702 from front side to the back side.

Figure 8:
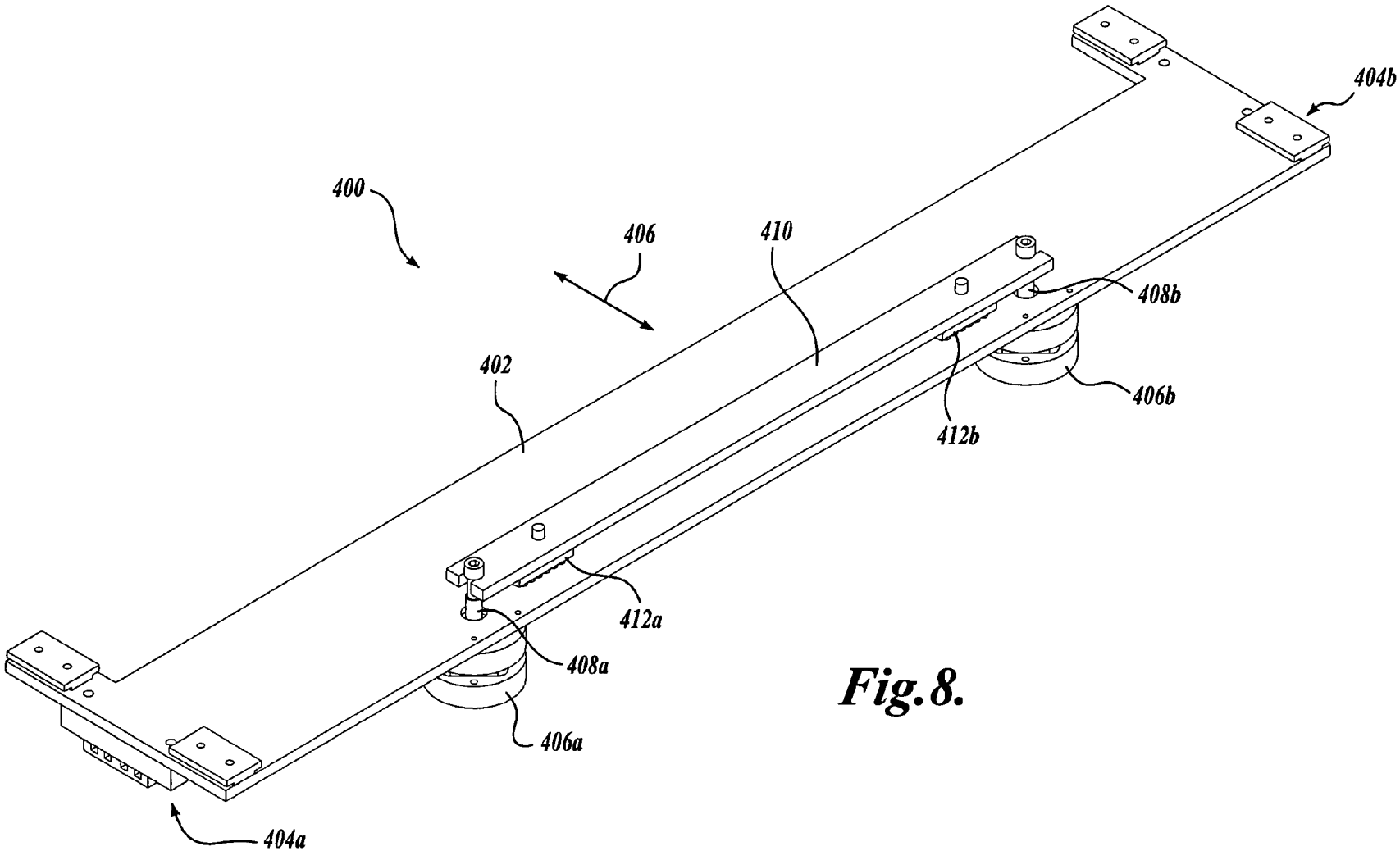
FIG. 8 is an illustration showing a partial view of a release mechanism sub-system in accordance with one embodiment of the present invention.

FIG. 8 is an illustration partially showing a release mechanism sub-system 400 made in accordance with one embodiment of the present invention. As stated above, release mechanism sub-system 400 is able to translate linearly forwards and backwards along the framework of the loader 10. The release mechanism sub-system 400 includes a transversely positioned platform 402 that spans a width greater than the width between winding reels 316*a* and 316*b*. At opposite ends of the platform 402, guide members 404*a* and 404*b* are located, which allow the platform 402 to be engaged on a rail that allows movement of the platform 402 forwards and backwards, as indicated by the double-headed arrow 406. At a predetermined time, the release mechanism sub-system 400 is moved close to and in proximity to the take-up mechanism sub-system 300 for initially grasping the ends of the straps 324*a* and 324*b*. After grasping the ends of the straps 324*a* and 324*b*, the release mechanism sub-system 400 is withdrawn, thereby paying out the straps 324*a* and 324*b*, and creating a sling sub-system 700 including a first and a second sling. The movement of the release mechanism sub-system 400 may be synchronized with the operation of the winding reels 316*a* and 316*b* by linking shaft 320 to the release mechanism sub-system 400. The platform 402 includes a first and a second actuator 406*a* and 406*b*, positioned on the underside of the platform 402. Actuators 406*a* and 406*b* can be pneumatic actuators, hydraulic actuators or voice coil actuators. Actuators 406*a* and 406*b* include a stem 408*a* and 408*b*, respectively, that moves linearly from a retracted position to an extended position. For example, pneumatic actuators 406*a* and 406*b* can have an internal diaphragm, which, when filled with air or a fluid push the stems 408*a* and 408*b* away from the body of the actuator. The torque is proportional to the air pressure and/or fluid pressure behind the diaphragm. Springs acting on the opposite side of the diaphragms return the stems 408*a* and 408*b* to the retracted position when the air or fluid is released from the diaphragm cavity. Alternatively, voice coil actuators are operated by supplying current to a coil within the actuator body. The torque in the case of voice coil actuators is proportional to the current. Linear-moving stems 408*a* and 408*b* penetrate through the platform 402 and are connected to a crossbar 410 at the respective opposite ends of the crossbar 410. Crossbar 410 includes a first and a second clamping jaw 412*a* and 412*b*, respectively. Clamping jaws 412*a* and 412*b* are located at the underside of the crossbar 410 and at a width that corresponds to the width between winding reels 316*a* and 316*b* shown in FIG. 7 to be aligned with the straps 324*a* and 324*b*. Therefore, clamping jaws 412*a* and 412*b* can clamp the end of straps 324*a* and 324*b* between the clamping jaws 412*a* and 412*b* and the upper surface of the platform 402. Prior to moving the release mechanism sub-system 400 in proximity of the take-up mechanism sub-system 300, the stems 408*a* and 408*b* are extended to raise the jaws 412*a* and 412*b*. The release mechanism sub-system 400 is then moved in position so that the ends of straps 324*a* and 324*b* are between the jaws 412*a* and 412*b* and the platform 402. Then, the actuators are commanded to retract and thereby close the jaws 412*a* and 412*b* against the straps 324*a* and 324*b*. Trip sensors may be used to verify the position of the release mechanism sub-system 400 at either side of the loading chamber 702. Once the straps 324*a* and 324*b* are clamped, the platform 402 may be translated linearly to the home position and across the loading chamber to pay out the straps 324*a* and 324*b* from winding reels 316*a* and 316*b*, while reels 316*a* and 316*b* apply a braking tension to keep the straps 324*a* and 324*b* taut. In order to ensure that release mechanism sub-system 400 is accurately positioned to clamp to straps 324*a* and 324*b*, a home setting sub-system 500 is provided to position the end of straps 324*a* and 324*b* at a predetermined location that can be accurately duplicated repeatedly for grasping by clamping jaws 412*a* and 412*b*.

Figure 9:
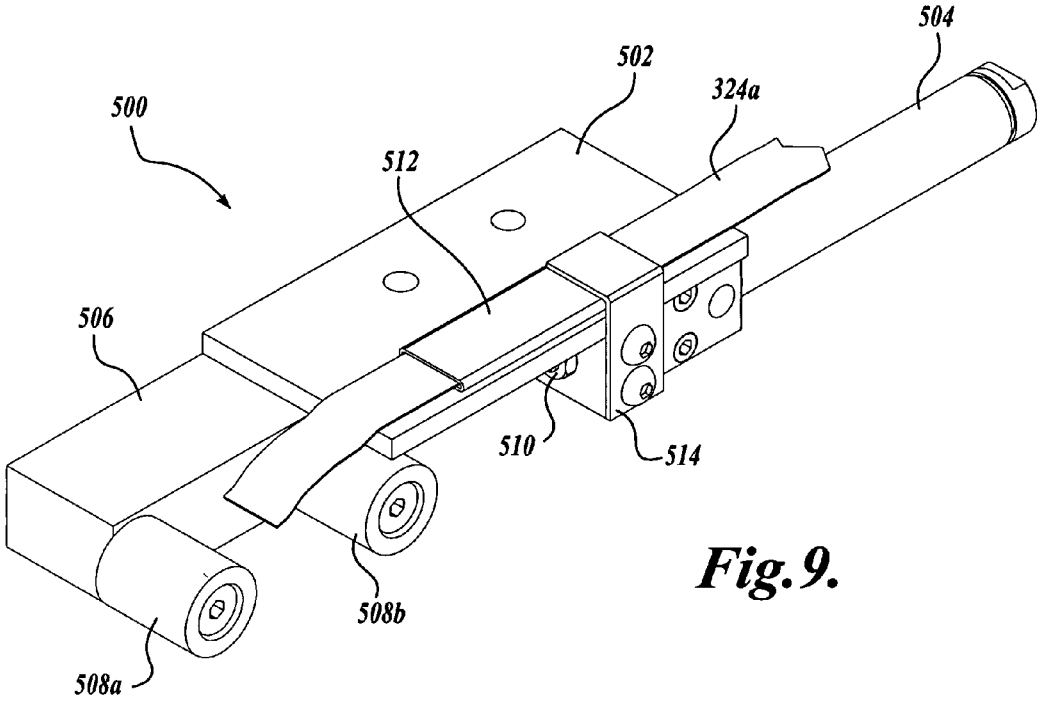
FIG. 9 is an illustration showing a partial view of a home setting mechanism sub-system in accordance with one embodiment of the present invention.
Figure 10:
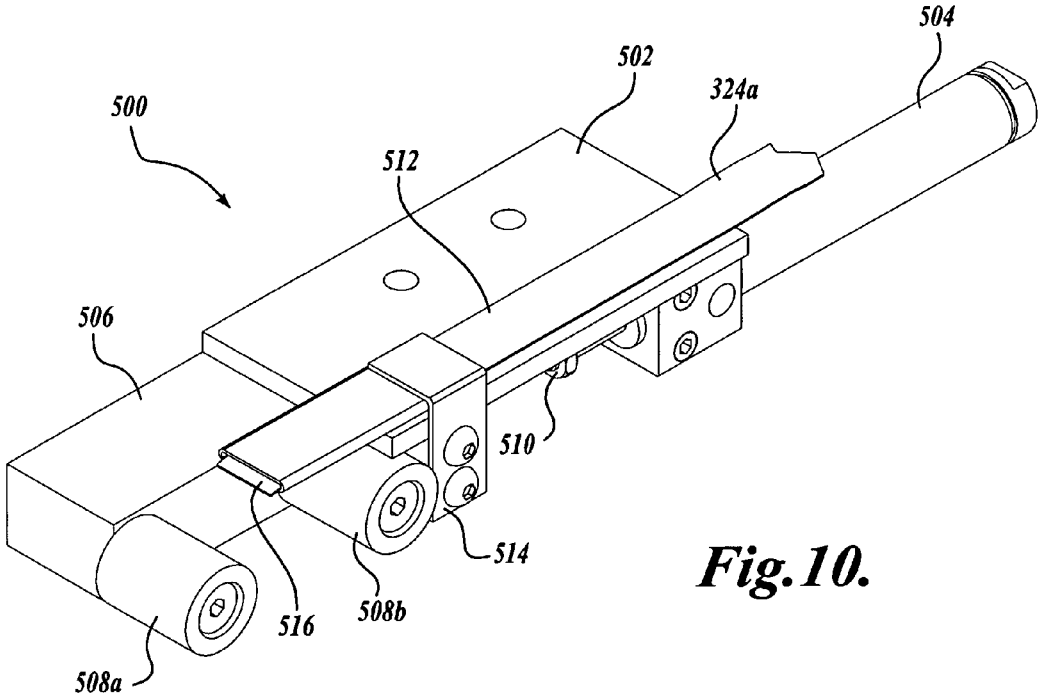
FIG. 10 is an illustration showing a partial view of a home setting mechanism sub-system in accordance with one embodiment of the present invention.

FIGS. 9 and 10 illustrate partial views of a home setting sub-system 500 made in accordance with one embodiment of the present invention. A home setting sub-system is provided for each strap to be used in the sling sub-system 700. The discussion below proceeds with the description of a single home setting sub-system 500 for strap 324*a*. Moreover, it is understood that a similar home setting sub-system can be used for strap 324*b*, or for as many straps as desired. Home setting sub-system 500 includes a platform plate 502. Platform plate 502 is attached to framework in proximity to the take-up mechanism sub-system 300 and aligned with the winding reel 316*a*, as shown in FIG. 7. A linear actuator 504 is connected to the platform plate 502. Linear actuator 504 can be a pneumatic or a voice coil actuator, for example. Actuator 504 includes a stem 510 which can be actuated from a retracted position to an extended position. Actuator 504 is controlled by software which synchronizes operation of the actuator 504 with other operations and components in the loader 10 according to a predetermined sequence under control of a computer. Platform plate 502 includes an extension bar 506 to which a first and a second stationary roller 508*a* and 508*b* are connected on one side of the extension bar 506. Stationary rollers 508*a* and 508*b* are referred to as a set. The end of stem 510 of actuator 504 is connected to a sliding block 514. A cover shield 512 is attached to the sliding block 514 at a top portion thereof. Therefore, by extending and retracting the stem 510, the cover shield 512 is also translated in unison with the motion of the stem 510. The cover shield 512 is configured to encircle the strap 324*a* on sides thereof, preferably three (3) or four (4) sides and for a certain length. The strap 324*a* approaches the cover shield 512 from an opening to the rear of the cover shield 512 and is threaded through the cover shield 512 to exit at the opposite end of the cover shield 512. As shown in FIG. 9, the stem 510 is retracted within the actuator body 504. The cover shield 512 exposes length of strap 324*a* forward of the cover shield 512. In this condition, the end of strap 324*a* would be difficult to grasp because of the limpness of the strap 324*a*. However, in FIG. 10, the cover shield 512 has been moved to cover a majority of the end of the strap 324*a*, exposing only a tongue 516. The tongue 516 of strap 324*a* can be positioned in a reliable and repeatable location, which facilitates grasping by clamping jaw 412*a* of the release mechanism sub-system 400. Stationary rollers 508*a* and 508*b* may also assist in supporting the platform 402 by engaging with the bottom of the platform 402 and accurately placing the platform 402 at the correct height, such that the tongue 516 is placed directly underneath clamping jaw 412*a*. Actuator 504 is operated at a predetermined time and in a predetermined sequence in accordance with a software program in a computer. After operation of actuator 504 to present a tongue 516 for grasping, the release mechanism sub-system 400 of FIG. 8 is moved to the position where clamping jaw 412*a* will be in alignment to grasp the tongue 512 of strap 324*a*. Grasping of the tongue 516 of the strap 324*a* is followed by retracting the cover shield 512 as shown in FIG. 9. Simultaneously with or sequentially, the release mechanism sub-system 400 is retracted, thereby pulling on the strap 324*a* and unwinding the strap 324*a* from the winding reel 316*a*. As will be discussed below, strap 324*a* will form a sling for holding items to be loaded into or onto a receptacle.

Figure 11:
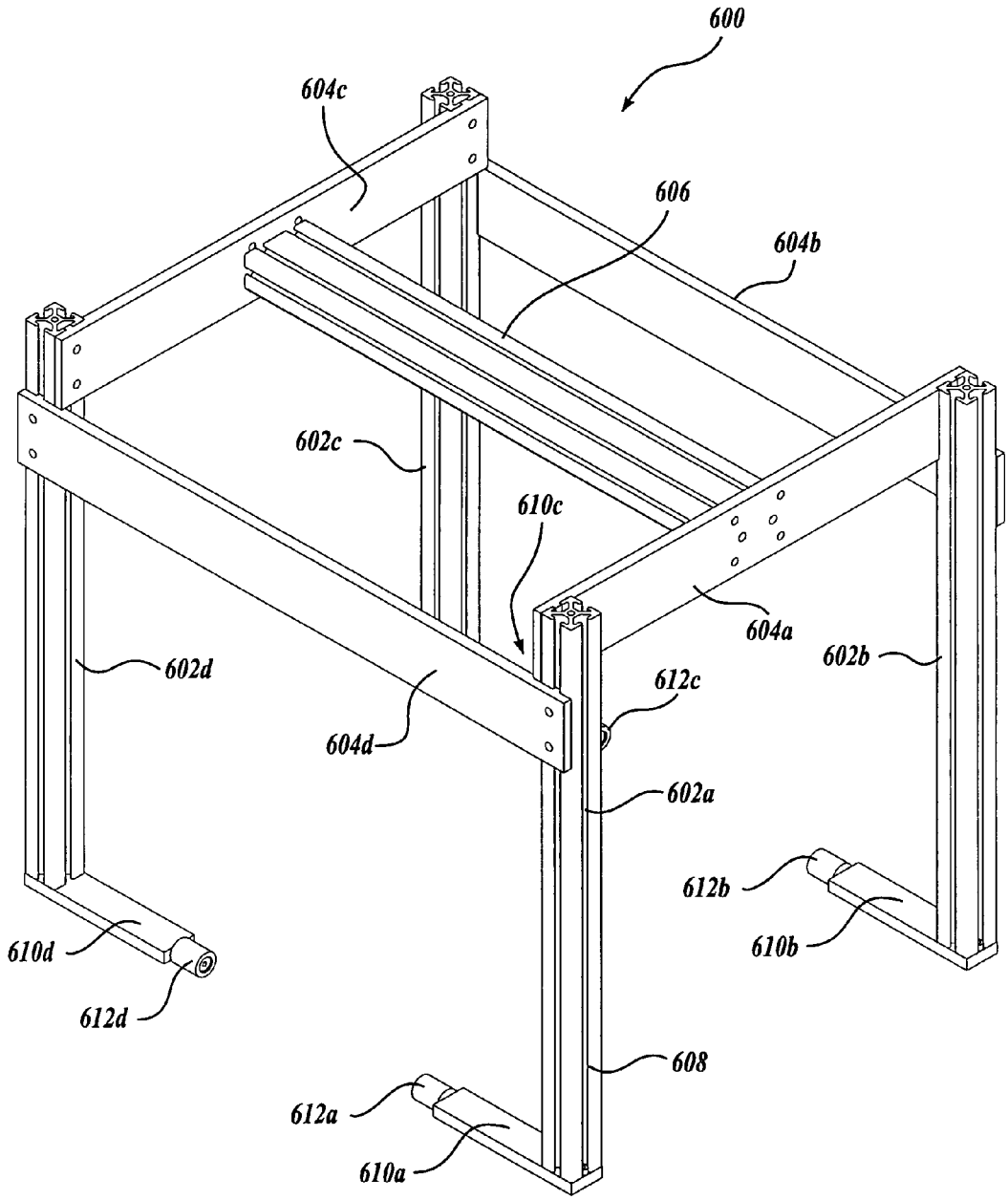
FIG. 11 is an illustration showing a partial view of a lowering mechanism sub-system in accordance with one embodiment of the present invention.

Referring to FIG. 1, lowering mechanism sub-system 600 makes contact with the straps 324*a* and 324*b* to assist in the formation of an adjustable sling sub-system 700 that lowers an item or items into or onto a receptacle. FIG. 11 is an illustration partially showing a lowering mechanism sub-system 600 in accordance with one embodiment of the present invention. Lowering mechanism sub-system 600 is for adjusting the height of the one or more slings of sling sub-system 700, as described below. Lowering mechanism sub-system 600 includes four vertical corner beams 602*a*, 602*b*, 602*c*, and 602*d*. The top portions of the corner beams 602*a*, 602*b*, 602*c*, and 602*d* are connected by bracing crossbeams 604*a*, 604*b*, 604*c*, and 604*d*. Bracing crossbeam 604*a* braces vertical corner beam 602*a* to vertical corner beam 602*b*. Bracing crossbeam 604*b* braces vertical corner beams 602*b* to vertical corner beam 602*c*. Bracing crossbeam 604*c* braces vertical corner beam 602*c* to vertical corner beam 602*d*. Finally, bracing crossbeam 604*d* braces vertical corner beam 602*d* to vertical corner beam 602*a*. A centrally located support crossbeam 606 is connected at the midpoints of bracing crossbeams 604*a* and 604*c*. The support crossbeam 606 includes a threaded nipple (not shown) welded or rigidly attached to the support crossbeam 606. The threaded nipple is engaged with a lead screw, described below. Vertical corner beams 602*a*, 602*b*, 602*c*, and 602*d* may include any number of grooves 608, either at the corners or centers of the corner beams. Grooves 608 allow the insertion of roller elements therein to guide the lowering mechanism sub-system 600 vertically upwards and downwards without substantial play and in accordance with the direction of rotation of the lead screw. Each vertical corner beam 602*a*, 602*b*, 602*c*, and 602*d* includes an extension plate 610*a*, 610*b*, 610*c*, and 610*d*, respectively, attached at the lower end of each of the corner beams. At the end opposite to the corner beam, a roller is attached to the extension plate. Rollers 612*a*, 612*b*, 612*c*, and 612*d* are attached to the extension plates 610*a*, 610*b*, 610*c*, and 610*d*, respectively. As will be described below, rollers 612*a*, 612*b*, 612*c*, and 612*d* assist in the lowering of a pair of slings. Rollers 612*a*, 612*b*, 612*c*, and 612*d* are referred to herein also as moving rollers because rollers 612*a*, 612*b*, 612*c*, and 612*d* move with the lowering and raising of the lowering mechanism sub-system 600, as contrasted with stationary rollers 508*a* and 508*b* and other stationary rollers, which will be described below.

Figure 12:
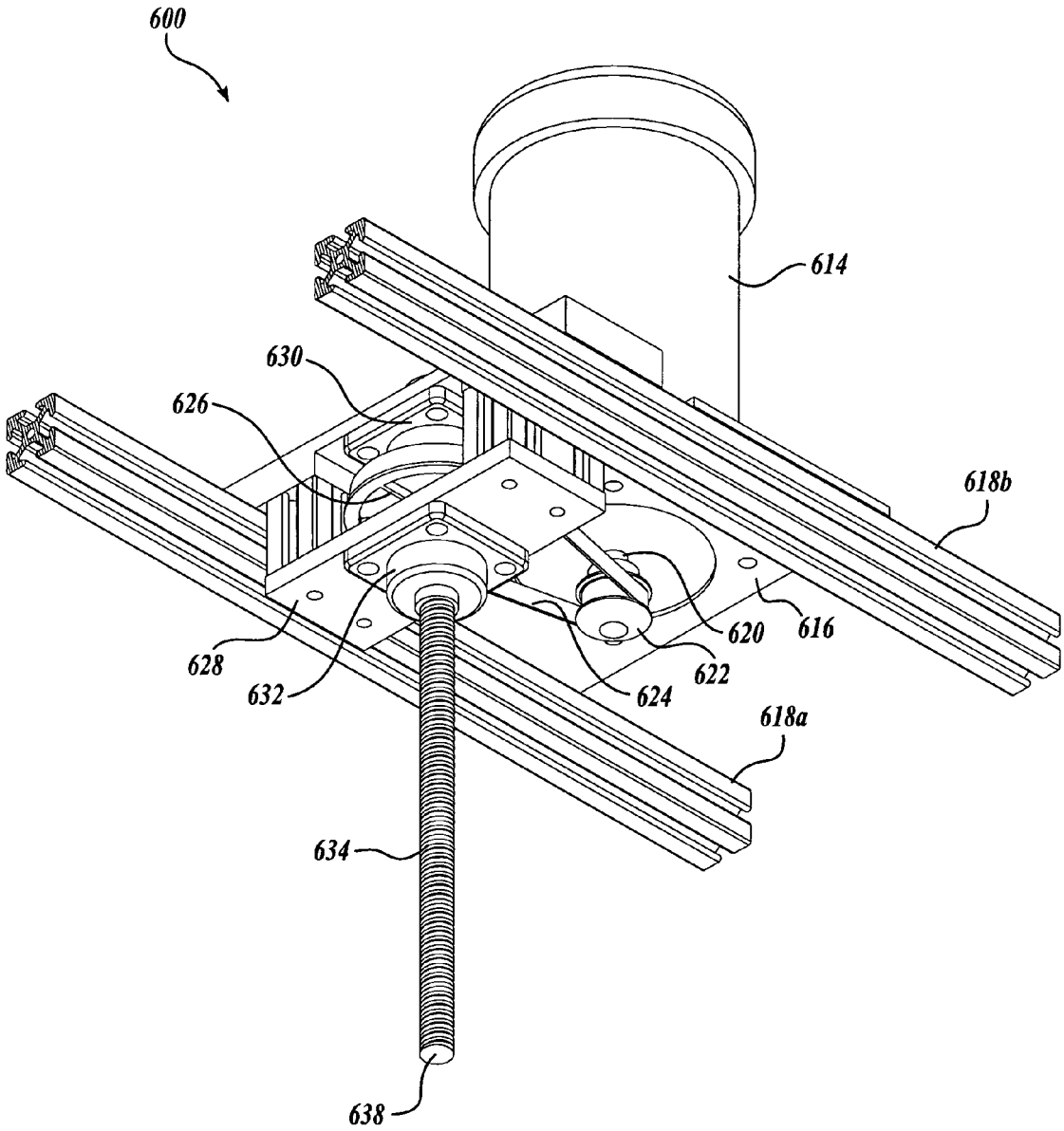
FIG. 12 is an illustration showing a partial view of a lowering mechanism sub-system in accordance with one embodiment of the present invention.

FIG. 12 illustrates another portion of the lowering mechanism sub-system 600. Lowering mechanism sub-system 600 includes an electric motor 614. Electric motor 614 has the capability to remotely start and stop in accordance with a software program that synchronizes the operation of motor 614 to one or more actions simultaneously with or sequentially at a predetermined time. Electric motor 614 is connected to motor mount 616. Motor mount 616 is connected across the motor mount beams 618*a* and 618*b*. Motor mount beams 618*a* and 618*b* are seen at the top of the loader 10 in FIG. 1 to be stationary and fixed to the loader 10. Electric motor 614 has a shaft 620 protruding through the motor mount 616. Motor shaft 620 is connected to a drive pulley 622. A flat timing belt 624 is looped over the drive pulley 622. Flat belt 624 is also looped around a gear reducing pulley 626. Gear reducing pulley 626 is larger in diameter than drive pulley 622, therefore, gear reducing pulley 626 increases the torque of the shaft to which gear reducing pulley 626 is attached. Gear reducing pulley 626 is enclosed within a cage 628. Cage 628 includes a pair of bearings 630 and 632. Bearing 630 may be a thrust bearing to bear an axial load. A lead screw 634 passes through roller bearing 632. The lead screw 634 is rigidly fixed to the gear reducing pulley 626 and is further supported by the bearing 630 at the top end of the lead screw 634. Lead screw 634 is therefore, rotated on command by operation of the dual-direction electric motor 614. The end 638 of lead screw 634 is engaged to the threaded nipple at the support crossbeam 606. Support crossbeam 606 includes a pivot for capturing the end 638 of lead screw 634. Therefore, as can be appreciated, operation of motor 614 in one direction causes rotation of lead screw 634 to rotate within the threaded nipple at the support crossbeam 606, thereby either raising or lowering the corner beams 602*a*, 602*b*, 602*c*, and 602*d* and the rollers 612*a*, 612*b*, 612*c*, and 612*d* on the ends thereof.

Figure 13:
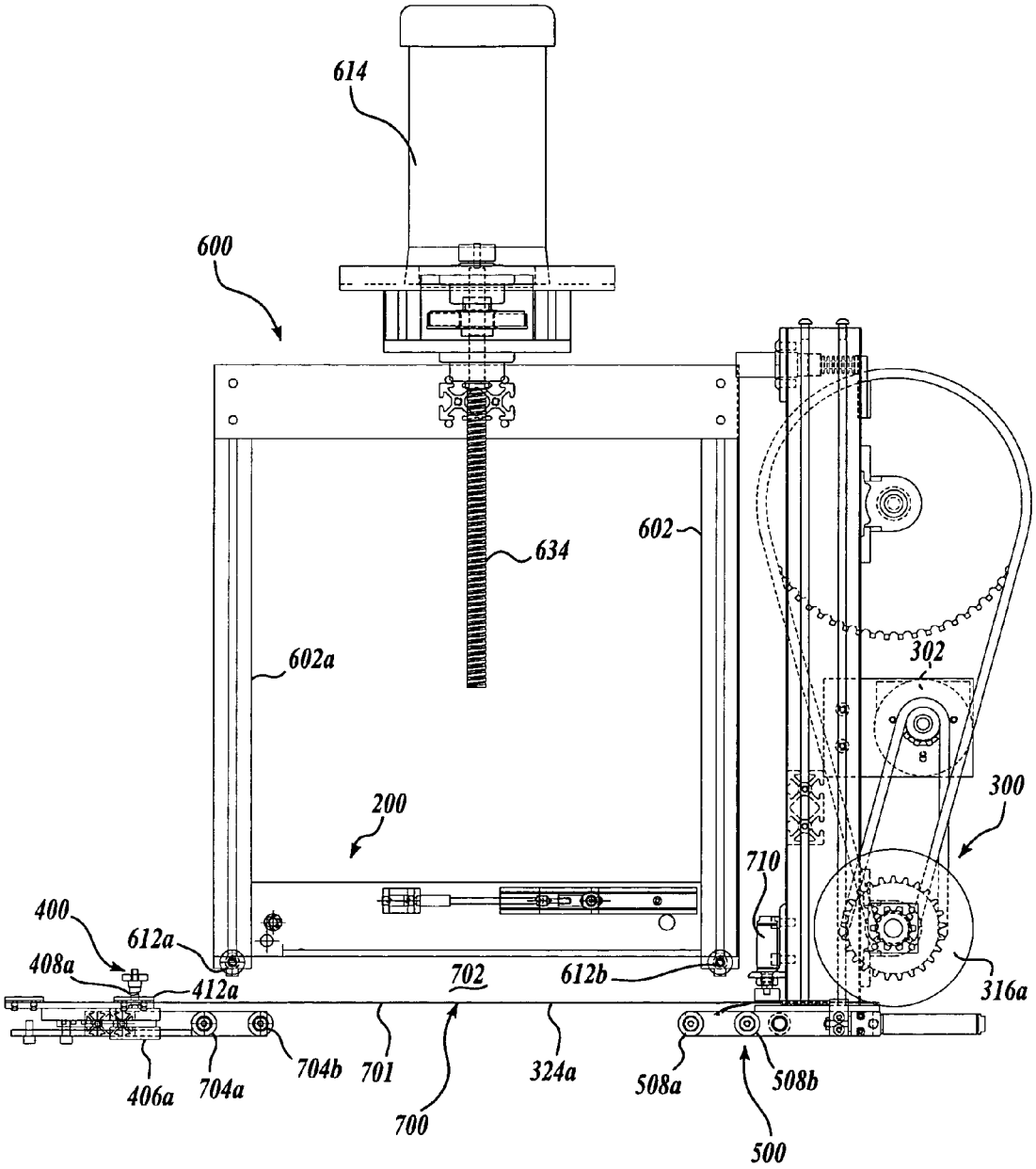
FIG. 13 is an illustration showing a partial view of a sling sub-system in accordance with one embodiment of the present invention.
Figure 14:
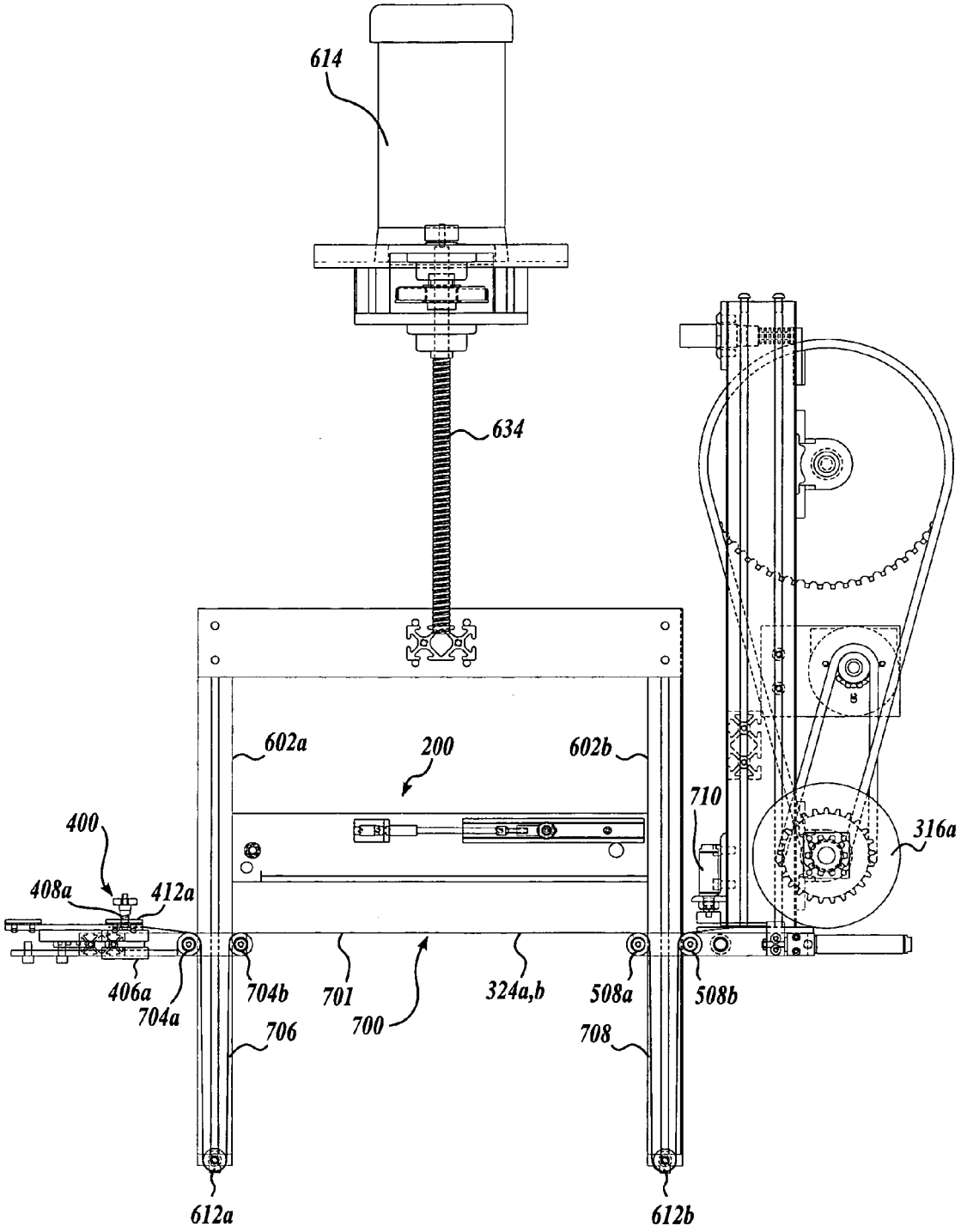
FIG. 14 is an illustration showing a partial view of a sling sub-system in accordance with one embodiment of the present invention.

Referring to FIGS. 13 and 14, one embodiment of a sling sub-system 700 is partially illustrated. FIG. 13 shows how various sub-systems work in unison to create a sling sub-system 700. FIG. 13 shows the take-up mechanism sub-system 300, the release mechanism sub-system 400, the home setting mechanism sub-system 500, and the lowering mechanism sub-system 600 contributing to the formation of a sling sub-system 700. The discussion proceeds with the description of the formation of a single sling 701. However, similar and corresponding elements are provided for the formation of a sling similar to sling 701, but are not illustrated for brevity and clarity. FIG. 13 shows the lowering mechanism sub-system 600 at an elevation which places the moving rollers 612*a* and 612*b* at the ends of the corner beams 602*a* and 602*b* above the height of the end of the strap 324*a* at the home setting mechanism sub-system 500. For brevity, only the sling 701 is described being formed from strap 326*a*. However, a second sling is understood to be similarly created from strap 326*b*. The release mechanism sub-system 400 is retracted to the home position and furthest from the home setting mechanism sub-system 500, which has pulled the strap 324*a* across the loading chamber 702. The operation of the sub-systems is controlled by a central computer which coordinates sequences of operations either sequentially or simultaneously. Preferably, multiple operations can occur simultaneously to increase the loading capacity per unit time of the loader 10.

As discussed above, the home setting mechanism sub-system 500 positions the end of the strap 324*a* at a reliable and a repeatable location. When strap 324*a* is at the known position, the release mechanism sub-system 400 is ready to be translated in proximity to the home setting mechanism sub-system 500 to grasp the end of the strap 324*a*. After clamping the end of the strap 324*a*, the release mechanism sub-system 400 is moved back to the home or retracted position as shown in FIG. 13. The release mechanism sub-system 400 has pulled the strap 324*a* across the loading chamber 702 from one side of the loading chamber 702 to the opposite side of the loading chamber 702. Strap 324*a* passes over a first and a second set of stationary rollers. Stationary set of rollers 508*a* and 508*b* is located at the home setting mechanism sub-system 500 on one side of the loading chamber 702. A second set of stationary rollers 704*a* and 704*b* is positioned across the loading chamber 702 on the opposite side to rollers 508*a* and 508*b*. As shown in FIG. 13, the sets of stationary rollers 704*a*, 704*b* and 508*a*, 508*b* are spaced sufficiently apart to allow the moving rollers 612*a* and 612' at the ends of the corner beams 602*a* and 602*b* to be lowered between the first and the second rollers of each set. Rollers 612*a* and 612*b* may also be described as "moving" rollers in comparison with the first and second set of rollers 508*a*, 508*b* and 704*a*, 704*b*, respectively, which are stationary. It is to be appreciated that each strap 324*a* and 324*b* is provided with a first and second set of stationary rollers. As illustrated in FIG. 13, the sling 701 of the sling sub-system 700 is linearly configured between the home setting mechanism sub-system 500 and the release mechanism sub-system 400 on opposite sides of the loading chamber 702. At this point, the sling 701 is secured by clamp 412*a* on one side of the loading chamber 702, and the release mechanism sub-system 400 is stationary for the duration of the loading operation. However, the opposite side is free to pay out more strap 324 length, as is described below.

FIG. 14 illustrates the lowering mechanism sub-system 600 having been lowered such that moving rollers 612*a* and 612*b* pass between and in alignment with the sets of stationary rollers 508*a*, 508*b* and 704*a*, 704*b*. This creates a first loop 706 and a second loop 708 in the sling 701. A similar second sling (not shown) is created from strap 326*b*. As the lowering mechanism sub-system 600 is lowered between and in alignment with the stationary rollers, the take-up mechanism 300 is allowing the winding reel 316*a* to rotate to pay out the strap 324*a*. During this operation, the motor 302 clutch may be slightly released to allow the reel 316*a* to freely rotate under a braking tension. The lowering of the lowering mechanism sub-system 600 to create first and second loops 706 and 708 in the strap 324*a* creates additional sling 701 length, which will allow the lowering of the center portion of the sling 701 under a weighted load. The shortening of the loops 706 and 708 caused by raising the lowering mechanism sub-system 600 will result in a lowering of the center portion of the sling 701 if the overall length of the sling 701 as initially formed is not changed. To this end, a presser clamp 710, which may be considered a component of the release mechanism sub-system 400, is positioned at the home setting mechanism sub-system 500 and at the opposite side of the clamping jaw 412*a*. The presser clamp 710 clamps the strap 324*a*, thereby setting a fixed length of strap 324*a* between the stopper clamp 710 and the jaw 412*a*. The presser clamp 710 is an actuator fitted with a pressing shoe that presses the strap 324*a* to a solid platform and thereby prevents the strap 324*a* from unwinding any further from the winding reel 316*a* under the weight of items. Therefore, when the lowering mechanism sub-system 600 is raised, the portion of the sling being weighted down by an item will correspondingly drop, thereby reducing the vertical height in the loops 706 and 708, and the center portion of the sling 701 will consequently be lowered under the weight of any items that are placed on the sling 701 created by the strap 324*a*. From FIG. 14, the following operations will sequentially place items on top of the sling 701, as described above in connection with the infeed conveyor sub-system 100 and the flap and flipper sub-system 200. The operation of the release mechanism sub-system 400, the lowering mechanism sub-system 600, the take-up mechanism sub-system 300, and sling sub-system 700 are centrally controlled by a computer running a software program performing a multiplicity of tasks simultaneously and/or sequentially to carry out loading a stack of items onto or into a receptacle.

Each side of the loader 10 can have its own set of stationary rollers and moving rollers for creating two slings from straps 326*a* and 326*b*, respectively. The stationary rollers include a set of front rollers and a set of back rollers spaced on opposite sides of the loading chamber 702. Likewise, the moving rollers include a front roller and a back roller for each strap. The front roller can pass between the first and second stationary rollers of the front set of stationary rollers. Likewise, the moving back roller can pass between the first and second stationary rollers of the back set of stationary rollers. A similar arrangement is provided on the other side of the loader 10. The lowering mechanism sub-system 600 moves downward causing four moving rollers to draw four loops in each of the straps after the straps have been pulled off of the reels and across the stationary rollers.

Returning to FIG. 1, the sling sub-system 700 is positioned above a box conveyor sub-system 800. The loading chamber 702 is in alignment with a corresponding location for an empty box.

Figure 15:
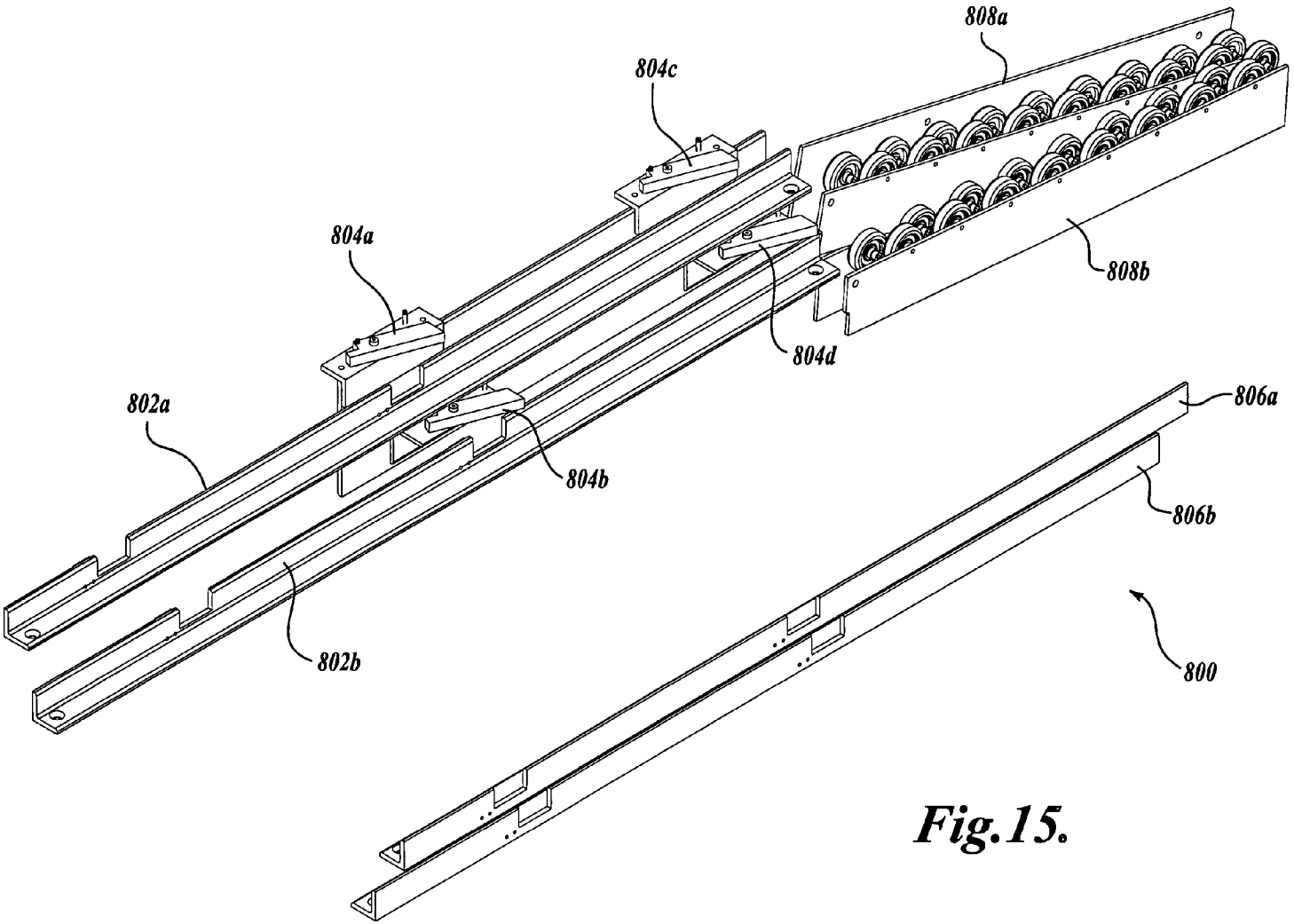
FIG. 15 is an illustration showing a box conveyor sub-system in accordance with one embodiment of the present invention.

FIG. 15 shows a portion of the box conveyor sub-system 800. Empty boxes (not shown) enter the box conveyor sub-system 800 from the lower left of FIG. 15, and filled boxes exit via the roller wheels at the upper right of the FIG. 15 when viewed in landscape. The box conveyor sub-system 800 includes an uppermost and lowermost rail 802*a* and 802*b*, respectively, for each side of the conveyor. Box conveyor sub-system 800 can be fed empty boxes via a typical conveyor system which is known and widely used for conveying boxes. The box conveyor sub-system 800 may include a set of inclined wheel rollers 808*a* and 808*b*, respectively, for each rail 802*a* and 802*b* that propels the box due to gravity. The uppermost and lowermost rails 802*a* and 802*b* each include a set of front box stoppers 804*a*, 804*b* and rear box stoppers 804*c*, 804*d*, which control the flow of boxes into and out of the loading location of box conveyor sub-system 800. Box stoppers 804*a*, 804*b*, 804*c*, and 804*d* are dogs that in the extended position project an inclined surface and a perpendicular surface in relation to the rails 802*a* and 802*b*. Box stoppers 804*a*, 804*b*, 804*c*, and 804*d* have a box stopping edge which is aligned generally perpendicular to the rails 802*a* and 802*b*, thus preventing the passage of boxes in one direction, while the sloped edge allows boxes to pass by but are prevented from reversing direction. For example, a first empty box may pass by the front box stoppers 804*a* and 804*b* on the upper and lower rail 802*a* and 802*b*, only when the box stoppers 804*a* and 804*b* are in alignment with the rails 802*a* and 802*b*. In other words, the box stoppers 804*a* and 804*b* are configured generally parallel to the rails 802*a* and 802*b* to allow the passage of boxes into the appropriate box position, directly or in alignment with the sling sub-system 700 and loading chamber 702 described above. Once a box has passed into the appropriate location underneath the sling sub-system 700, the front box stoppers 804*a* and 804*b* are actuated to the extended position to prevent the box from shifting forward or backward, or from a new box inadvertently bumping into the previously positioned box and misaligning the box. Once the items have been loaded into or onto a box or other receptacle, the front box stoppers 804*a* and 804*b* and the rear box stoppers 804*c* and 804*d* can be retracted to the parallel position to allow an exit path for the loaded box and an entry path for an empty box. Box stoppers 804*a* and 804*c* on rail 802*a* and box stoppers 804*b* and 804*d* on rail 802*b* can be synchronized to act in unison to allow a filled box to leave the loading location, while an empty box comes in right behind the full box. Box stoppers 804*a*, 804*b*, 804*c*, and 804*d* may be spring loaded to bias the box stoppers 804*a*, 804*b*, 804*c*, and 804*d* to the extended position, and shuttled to the retracted position with a pneumatic or voice coil actuator.

Figure 16:
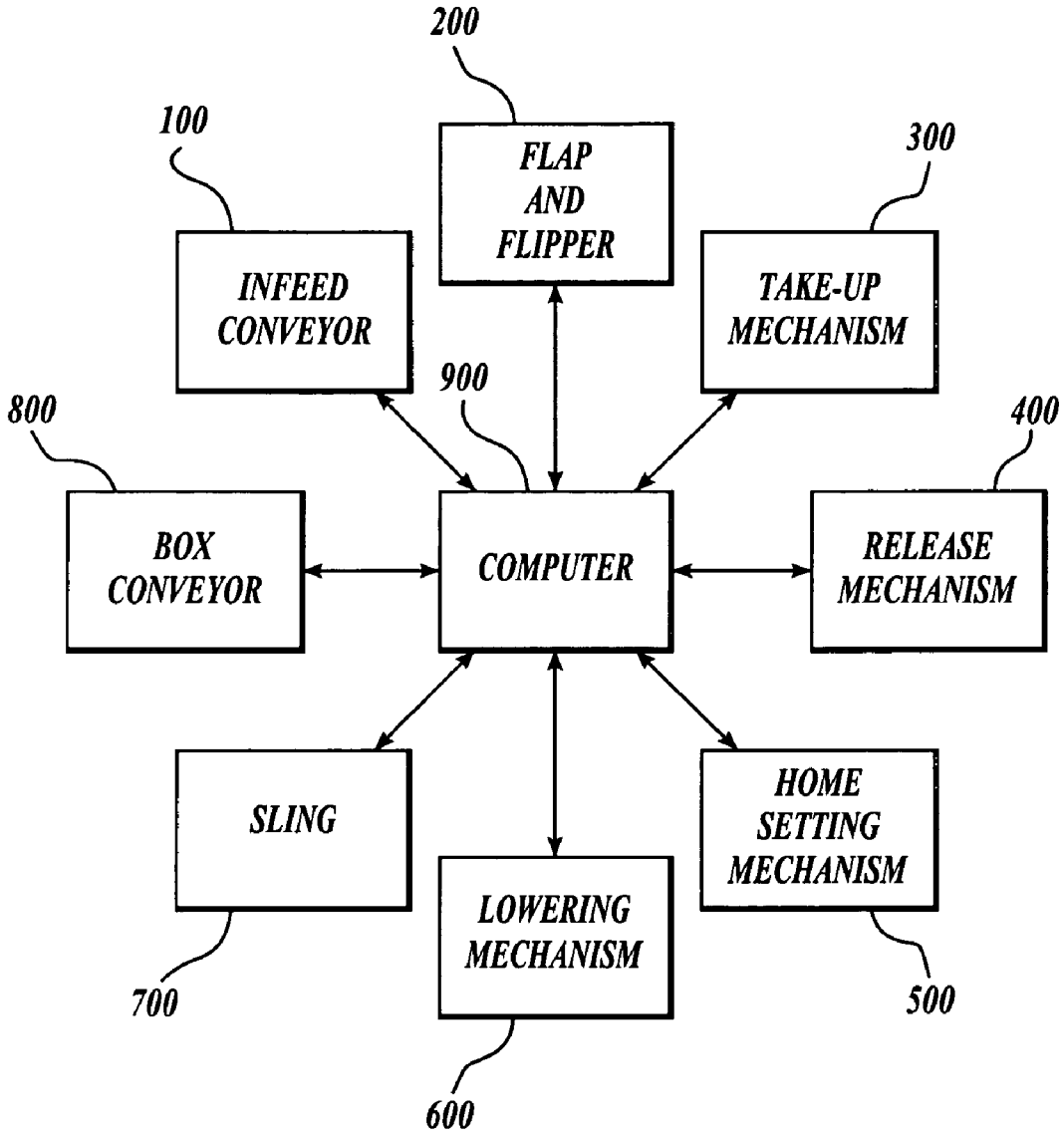
FIG. 16 is a schematic illustration of a computerized control system for a box loader in accordance with one embodiment of the present invention.
Figure 17:
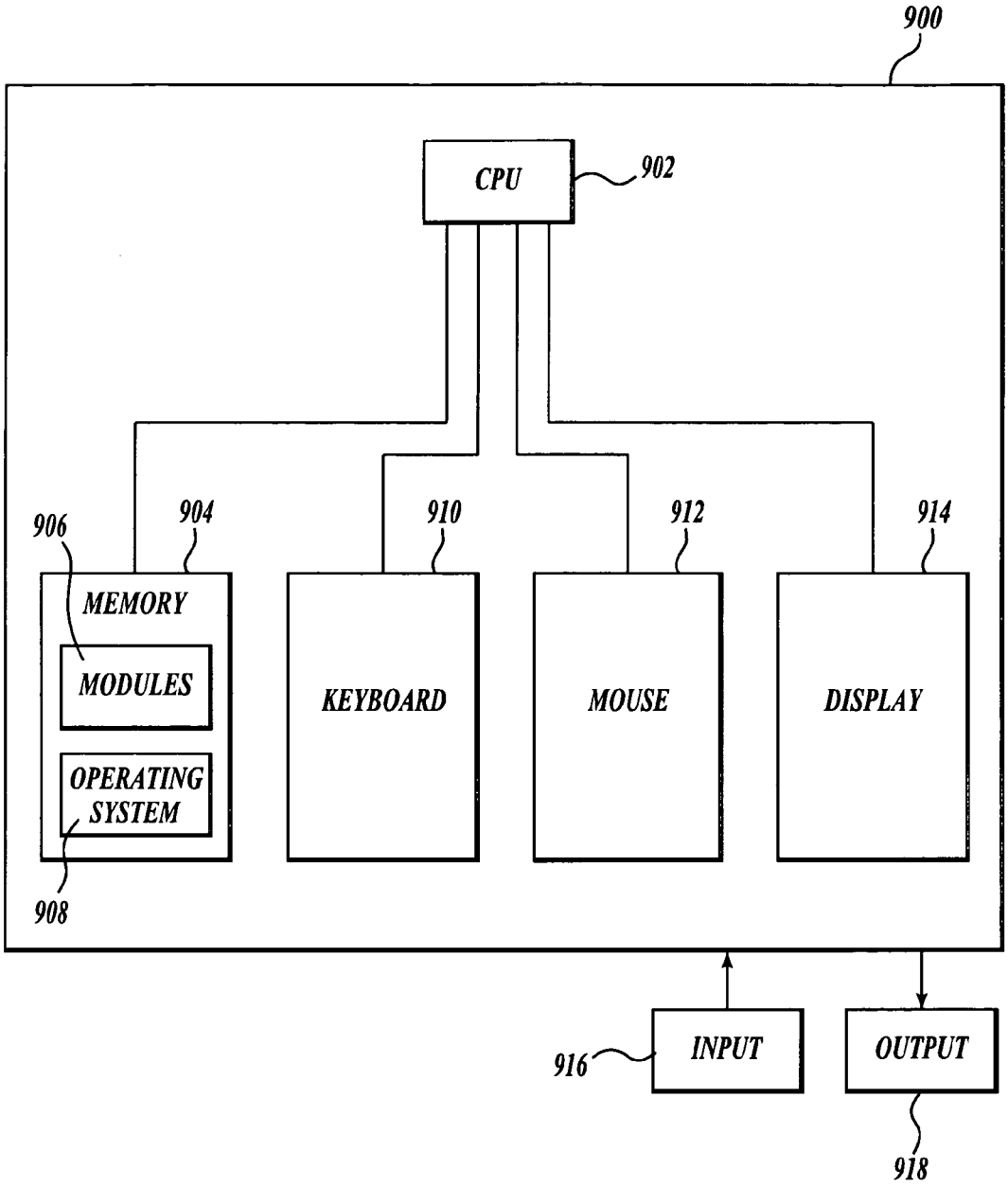
FIG. 17 is a schematic illustration of a computer containing a program module to execute instructions for loading items into or onto a receptacle in accordance with one embodiment of the present invention.

Referring to FIGS. 16 and 17, the multiplicity of sub-systems, including the infeed conveyor 100, flap and flipper 200, take-up mechanism 300, release mechanism 400, home setting mechanism 500, lowering mechanism 600, sling 700, and box conveyor 80, are illustrated in communication with a central computer 900. Computer 900 issues commands to the respective sub-systems according to a predetermined sequence of instructions stored in the computer 900 in a computer readable medium. Commands may be in the form of electrical signals, which operate an electrical switch or solenoid to turn on or turn off a motor, and/or a valve to supply air to an actuator, motor, or other driver, etc. Similarly, computer 400 may receive signals from the loader 10 that indicate the status of certain of the loader sub-systems. Such signals can come from light switches, contact switches, trip sensors, etc., that indicate whether a certain action has, in fact, occurred. Based on inputs coming from the various switches and sensors, the central computer 900 is able to execute commands to the various sub-systems mentioned above.

Referring to FIG. 17, the computer 900 includes a central processing unit (CPU) 902, a computer readable storage medium, or memory, 904 containing program modules 906 for a method of loading, an operating system 908, a keyboard 910 and/or a mouse for operator input, and a display 914. The computer 900 contains software and hardware that allows the computer 900 to issue commands via port 918 and to receive signals via port 916 to process and form appropriate decisions according to the program modules 906. By way of example, and not limitation, computer readable storage medium 904 may include volatile and non-volatile, removable and non-removable media implemented in any method or technology for storage of information such as computer readable instructions, data structures, program modules, or other data. Computer readable storage media includes, but is not limited to, RAM, ROM, EEPROM, flash memory, or other memory technology, CD-ROM, digital versatile disks (digital video-disc) (DVD) or other optical storage, magnetic cassettes, magnetic tape, magnetic disk storage or other magnetic storage devices, or any other medium which can be used to store the desired information.

For illustration purposes, one embodiment of the present invention will be described for loading trays filled with produce into boxes. However, it is to be appreciated that the present invention has other applications in the areas of loading or packing, where an item needs to be placed in or on a receptacle. A receptacle can be a container, such as a box, drum, bag; or a platform, such as a pallet.

Figure 18:
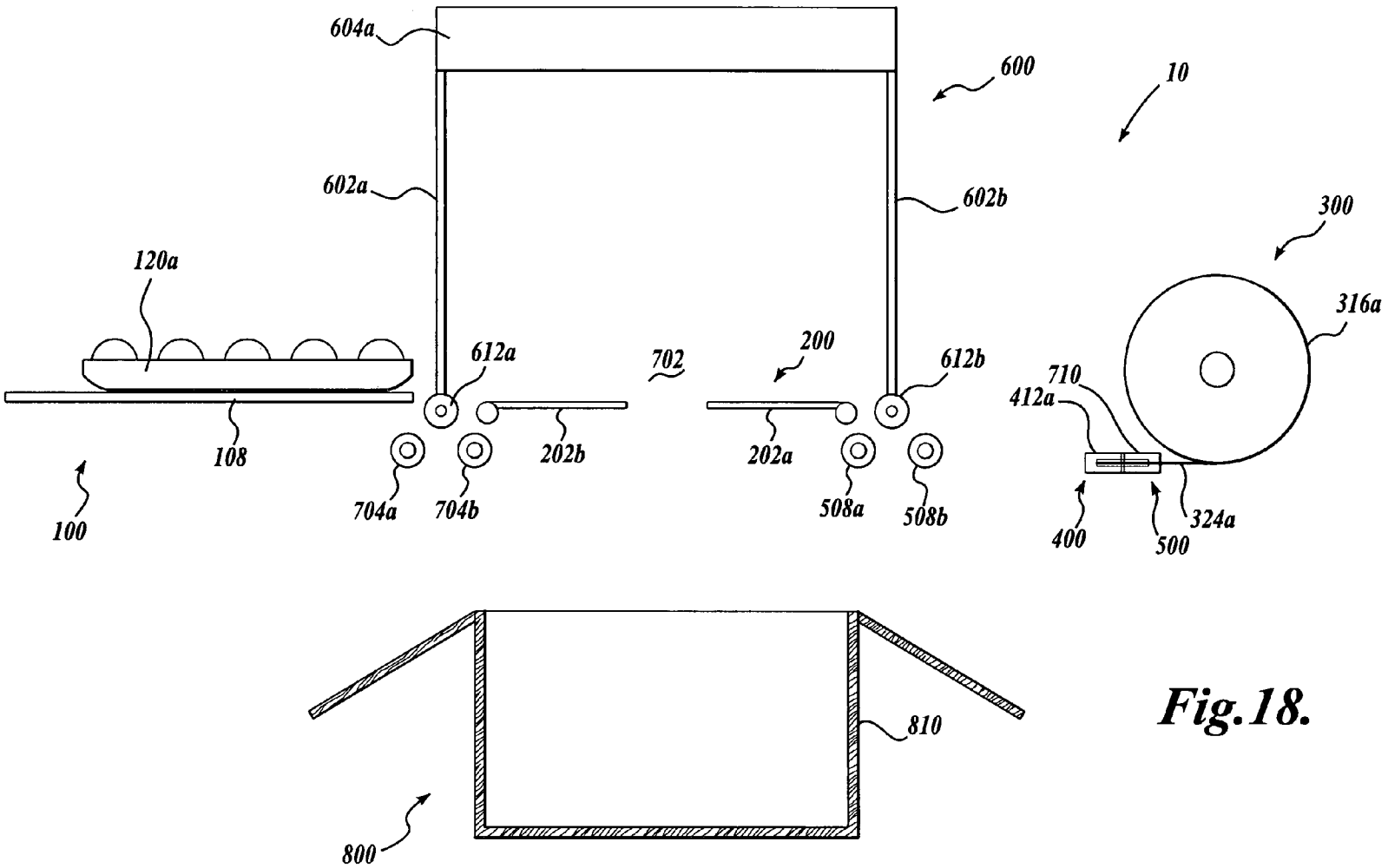
FIG. 18 is a schematic illustration of an apparatus made in accordance with one embodiment of the present invention at a stage of loading an item in a box.

FIG. 18 schematically illustrates the loader 10. The following description proceeds with the description of a single sling 701. However, more than one sling 701 can be provided. A single flexible sling 701 can be made from a belt that is of sufficient width to carry an item, or multiple flexible slings can be spaced at intervals along the item. The loader 10 includes the infeed conveyor sub-system 100. The infeed conveyor sub-system 100 is for delivering items to the flap and flipper sub-system 200. The infeed conveyor sub-system 100 includes the slats 108. The slats 108 are illustrated carrying an item 120*a*, such as a tray with produce, to be loaded into a receptacle 810. At this point, the item 120*a* has tripped a sensor indicating that the item 120*a* has arrived at the slats 108. The item 120*a* will proceed to the loading chamber 702 if the loading chamber 702 is clear. The flap and flipper sub-system 200 includes a first flap 202*a* and a second flap 202*b*, initially positioned horizontally, but configured to rotate vertically to arrive at a downward vertically pointing position. The lowering mechanism sub-system 600 is shown positioned above and in proximity to the flap and flipper sub-system 200. The lowering mechanism sub-system 600 includes a first corner beam 602*a* and a second corner beam 602*b* supported at the upper ends thereof by the crossbeam 604*a*. At the lower end of the vertical corner beam 602*a*, a moving roller 612*a* is positioned. At the lower end of the vertical corner beam 602*b*, a moving roller 612*b* is positioned. The loading chamber 702 is generally the area within the vertical corner beams 602*a* and 602*b*. The loading chamber 702 can extend upwards up to the crossbeam 604*a*. The loading chamber 702 is also the area in and around the first flap 202*a* and the second flap 202*b*. The loading chamber 702*a* also includes the space between and extending into the cavity of the receptacle 810. A first, forward set of stationary rollers includes a first roller 704*a* and a second 704*b*. The roller 704*a* is positioned forward of the moving roller 612*a*. The second stationary roller 704*b* is positioned to the rear of the moving roller 612*a*. A second and rear set of stationary rollers includes the rollers 508*a* and 508*b*. The stationary roller 508*a* is positioned forward of the moving roller 612*b*. The stationary roller 508*b* is positioned to the rear of the moving roller 612*b*. The lowering mechanism sub-system 600 is able to move linearly upwards and downwards, such that the moving rollers 612*a* and 612*b* pass between the first and second roller of each set of stationary rollers and in alignment to the rollers. For example, the moving roller 612*a* passes between and aligned with the rollers 704*a* and 704*b*. The moving roller 612*b* passes between and aligned with the rollers 508*a* and 508*b*. Towards the lower end of the loading chamber 702, the receptacle 810 is positioned. Receptacle 810 is moved into position within the loading chamber 702 by a box conveyor sub-system 800. The release mechanism 400 includes a clamp 412*a*. The clamp 412*a* can clamp to one end of the strap 324*a*. The take-up mechanism sub-system 300 includes the winding reel 316*a*. The winding reel 316*a* includes the strap 324*a* spooled on the winding reel 316*a*. One end of the strap 324*a* is anchored to the winding reel 316*a*. A second end of the strap 324*a* terminates at the home setting mechanism sub-system 500. The home setting mechanism sub-system 500 includes a cover shield (not shown), as described above. The cover shield is for locating the end of the strap 324*a* at a known, reliable, and reproducible location. The release mechanism sub-system 400 includes at least two clamps, 412*a* and 710. The clamp 710 is positioned on one side of the loading chamber 702, closest to the take-up mechanism sub-system 300 and to the home setting mechanism sub-system 500. A second clamp 412*a* is translatable across the loading chamber 702 on command. For example, as illustrated in FIG. 16, the clamp 412*a* is currently at the location on one side of the loading chamber 702 to allow the clamp 412*a* to grasp the end of the strap 324*a*. After grasping the end of the strap 324*a*, the clamp 412*a* will be translated, moved from one side of the loading chamber 702 to the forward side of the loading chamber 702. In this manner, a sling will be formed from one side of the loading chamber 702 to the opposite side of the loading chamber 702.

Figure 19:
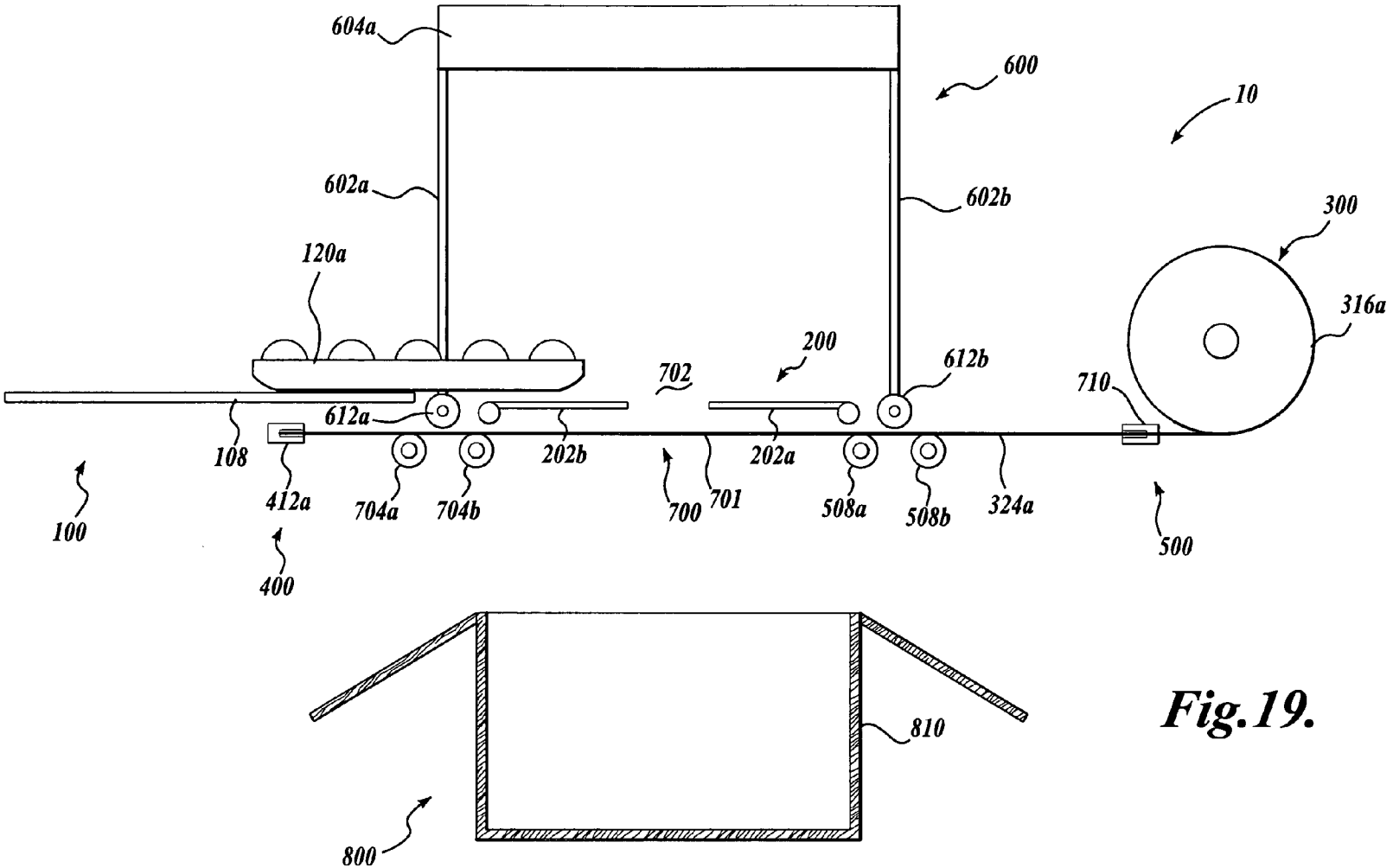
FIG. 19 is a schematic illustration of an apparatus made in accordance with one embodiment of the present invention at a stage of loading an item in a box.

FIG. 19 schematically illustrates the sling 701 being formed from one side of the loading chamber 702 to the opposite side of the loading chamber 702 by the clamp 412*a* clamping to the end of the strap 324*a* and pulling the strap 324*a*, thereby creating the sling 701. The strap 324*a* has been passed above the stationary rollers 704*a*, 704*b* and 508*a*, 508*b*, and below the moving rollers 612*a*, 612*b*. The area of the sling 701 between the front and back set of stationary rollers 508*a*, 508*b*, 704*a*, and 704*b* will be used to lower a stack of items into a waiting receptacle 810. The item 120*a* is illustrated being carried by the motion of the slats 108 extending into the loading chamber 702, and above the sling 701 and the flaps 202*a* and 202*b*. The lowering mechanism 600 is beginning to lower the moving rollers 612*a* and 612*b* to engage the sling 701 between the first and the second set of stationary rollers 508*a*, 508*b*, 704*a*, and 704*b* in order to form first and second loops in the sling 701. The empty receptacle, such as box 810, has been positioned in the box conveyor 800 directly in the line of the loading chamber 702.

Figure 20:
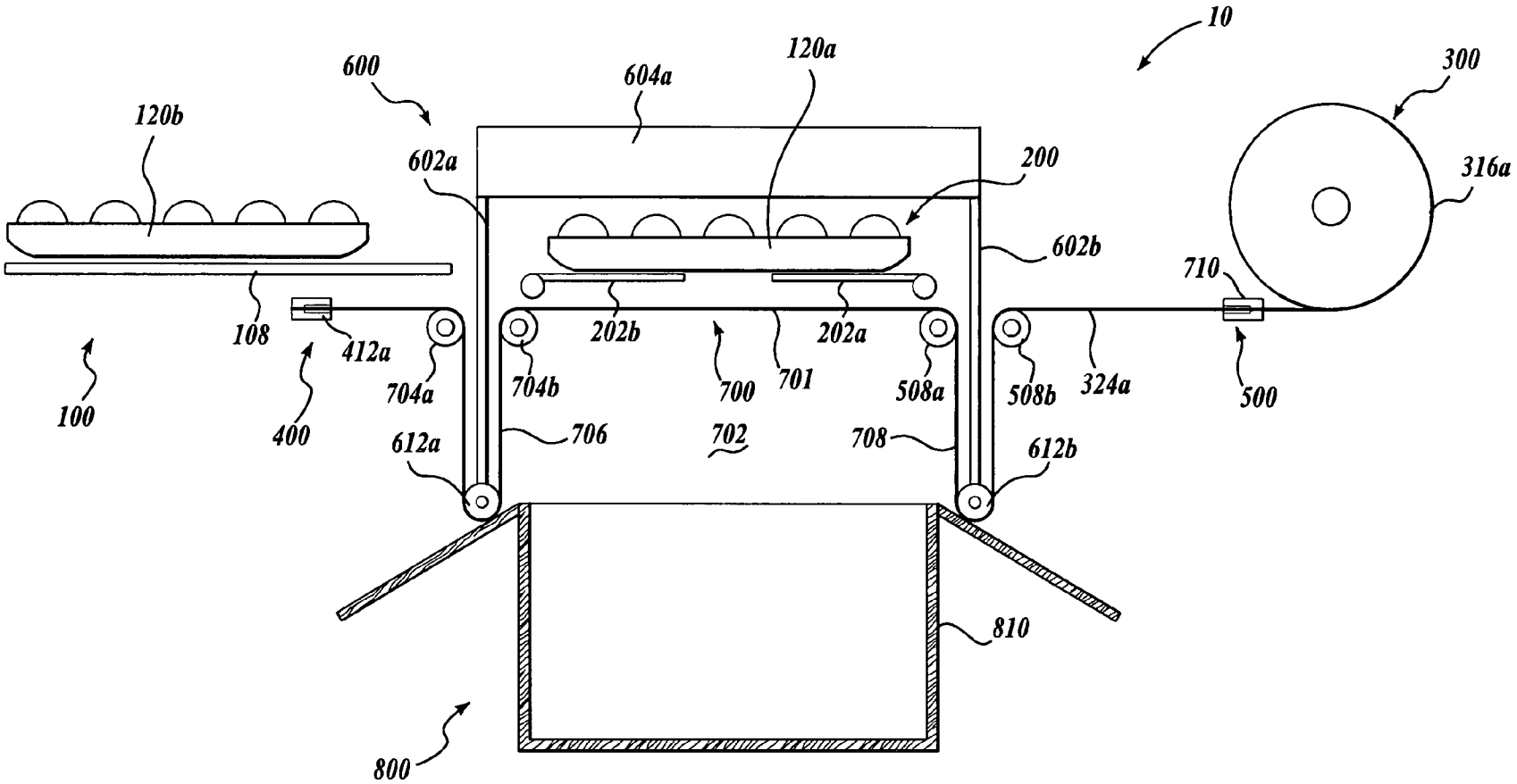
FIG. 20 is a schematic illustration of an apparatus made in accordance with one embodiment of the present invention at a stage of loading an item in a box.

FIG. 20 schematically illustrates the lowering mechanism 600 has been lowered sufficiently, thus forming a first loop 706 and second loop 708 from strap 324*a* between the first roller and the second roller in each of the sets of stationary rollers 508*a*, 508*b*, 704*a*, and 704*b*. The jaw 4.12*a* of the release mechanism 400 is clamped to one end of the strap 324*a*, while the presser clamp 710 is clamped to the strap 324*a* at the side of the loading chamber 702 that is opposite to the jaw 412*a*, thereby creating a temporary sling 701 of a temporary fixed length across the loading chamber 702. The moving front and back rollers 612*a* and 612*b* have passed between the first roller 704*a* and the second roller 704*b*, and the first roller 508*a* and the second roller 508*b*, respectively. As the lowering mechanism 600 is commanded to descend, the take-up mechanism 600 will allow the strap 324*a* to be spooled from the winding reel 316*a*, however, the take-up mechanism 600 maintains a certain amount of slight tension on the strap 324*a*. The amount of strap 324*a* that is paid out and stored as loops 706 and 708 is substantially the amount that will be necessary for the sling 701 to nearly reach the bottom of the receptacle 810 under the weight of an item, as will be described below. A second item 120*b* has arrived at the slats 108 and has activated a trip sensor to confirm arrival at the slats 108. If the loading chamber 702 is clear, the slats 108 will extend to deliver the second item 120*b* to the loading chamber 702.

Figure 21:
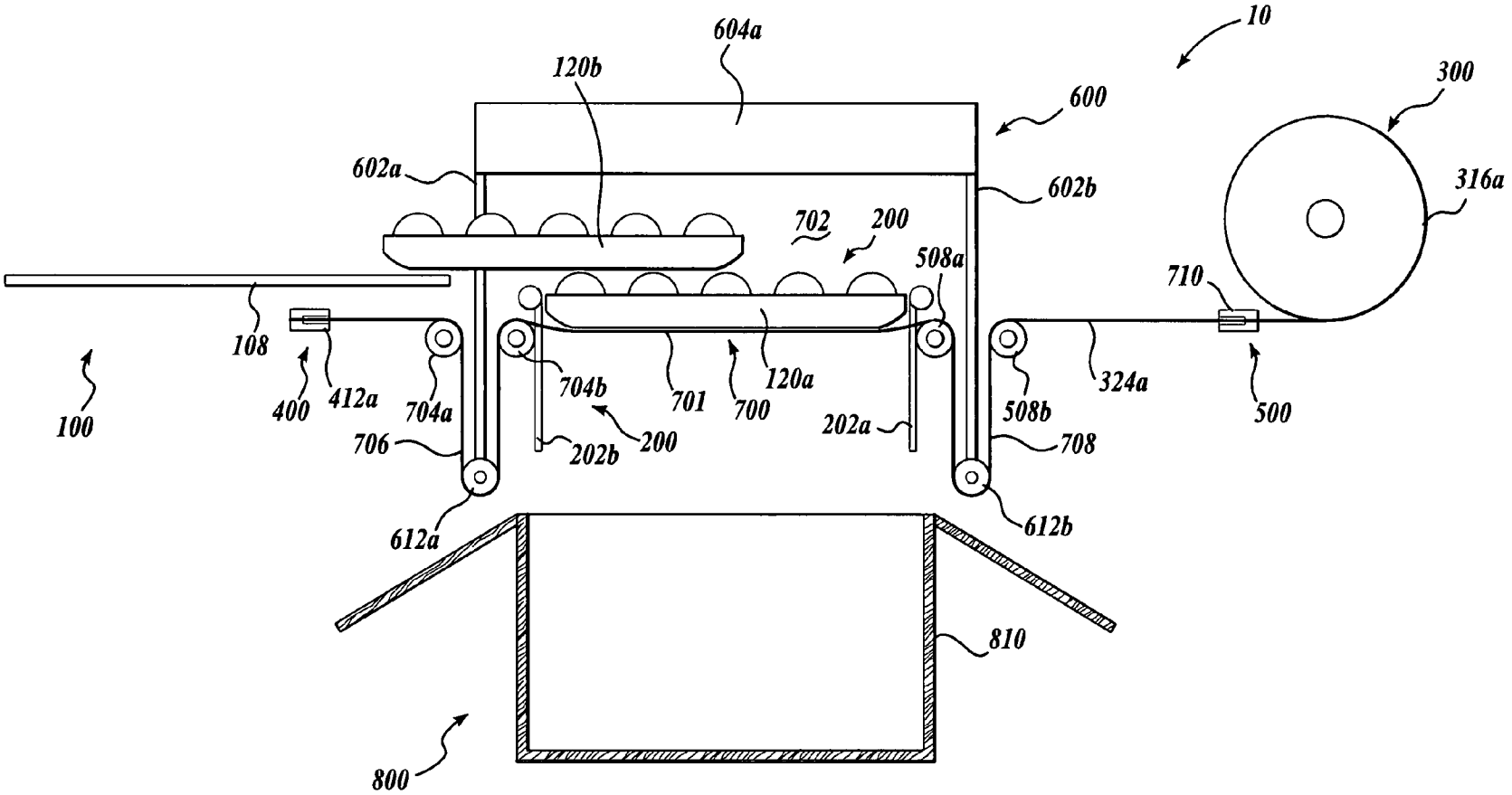
FIG. 21 is a schematic illustration of an apparatus made in accordance with one embodiment of the present invention at a stage of loading an item in a box.

FIG. 21 schematically illustrates the flaps 202*a* and 202*b* having been rotated vertically downward, thereby placing the first item 120*a* on the sling 701. As can be appreciated from FIG. 3, the flaps 202*a* and 202*b* have cutouts to allow portions of the flaps 202*a* and 202*b* to extend below the top surface of the sling 701. The lowering mechanism 600 has been indexed upwards an increment sufficient to clear room for the second item 120*b* on top of the first item 120*a*. When the lowering mechanism 600 is raised, the moving rollers 612*a* and 612*b* also rise releasing stored length of strap 324*a* from the loops 706 and 708. The amount of strap 324 is constant between the clamps 412*a* and 710. The height of the sling 701 in the loading chamber 702 drops under the weight of the item 120*a*, and a clear flag is set. Once the clear flag is set, the slats 108 will begin to extend to deliver the second item 120*b* to the loading chamber 702. The computer 900 is able to determine the state of the flaps 202*a* and 202*b*. If the flaps 202*a* and 202*b* are horizontal, and none or only one tray 120*a* is on the flaps 202*a* and 202*b*, and a second item 120*b* is at the slats 108, the slats 108 will extend to carry the second item 120*b* to the stack formed by the first item 120*a*. Meanwhile, a third item is approaching the infeed conveyor 100 to the left of the FIG. 21, but is not shown.

Figure 22:
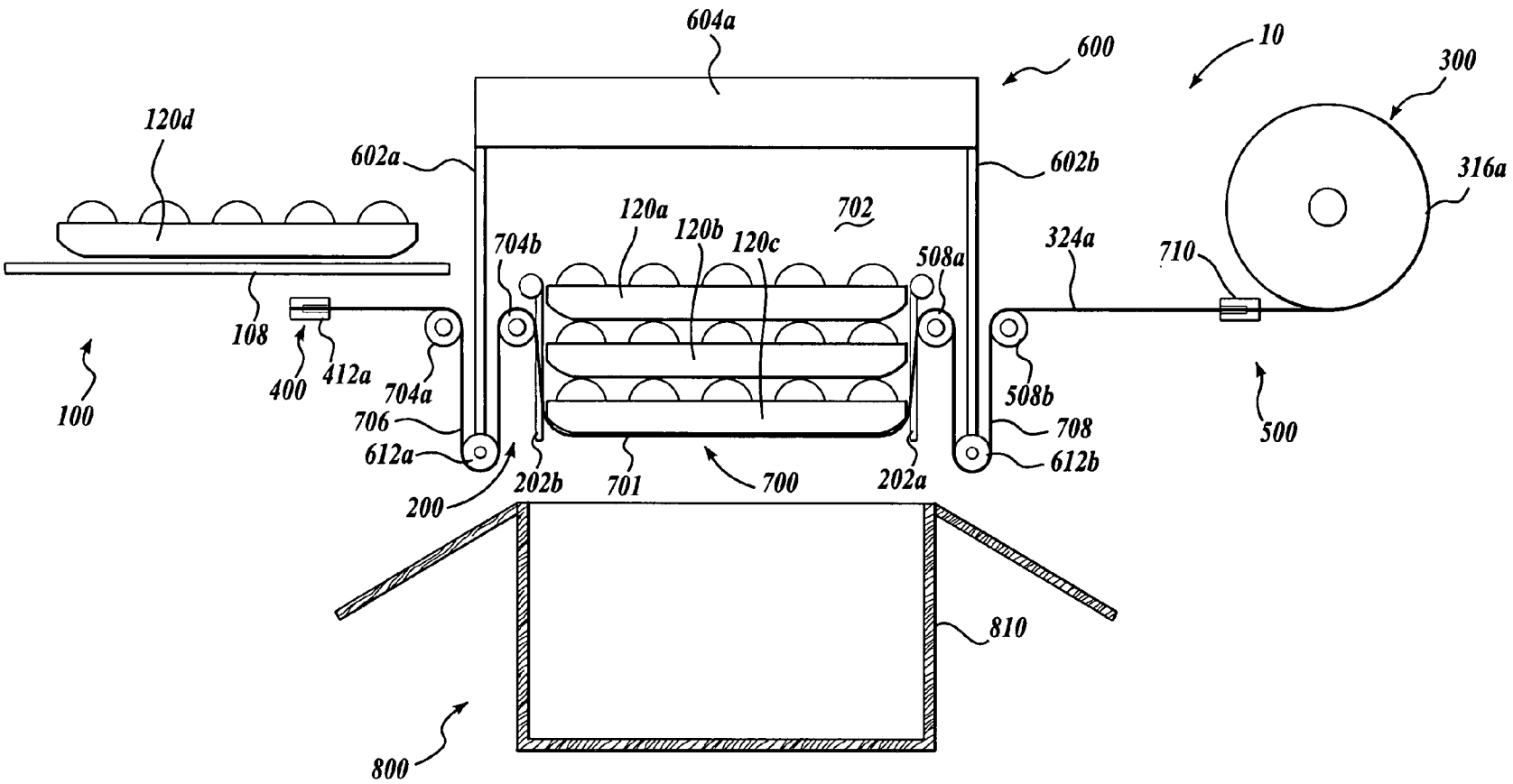
FIG. 22 is a schematic illustration of an apparatus made in accordance with one embodiment of the present invention at a stage of loading an item in a box.

FIG. 22 schematically illustrates the subsequent placement of item 120*c* atop items 120*a* and 120*b* in a stack supported by the sling 701. After placement of an item on the stack, the lowering mechanism 600 indexes upwards, thereby shortening the loops 706 and 708 so that the center portion of the sling 701 will drop leaving room for more items. The computer 900 indexes the lowering mechanism 600 to rise a predetermined amount that corresponds approximately to the height of a tray 120*d* with produce, after each delivery of a tray on the stack. The computer 900 is also able to track the number of items 120*a*, 120*b*, and 120*c* in the stack and can determine when the stack has been completed so that the stack may be lowered into the waiting empty box 810. Alternatively, trip sensors (not shown) may be strategically positioned at the appropriate locations that can confirm when the stack has been lowered sufficiently. Also shown in FIG. 22 is the fourth item 120*d* on the slats 108 that has tripped the position sensor, that indicates the item 120*d* is ready to be placed atop the stack with the indexing of the lowering mechanism 600 and the lowering of the sling 701. The stacking cycle may be repeated for any number of items that can be accommodated in the loading chamber 702.

Figure 23:
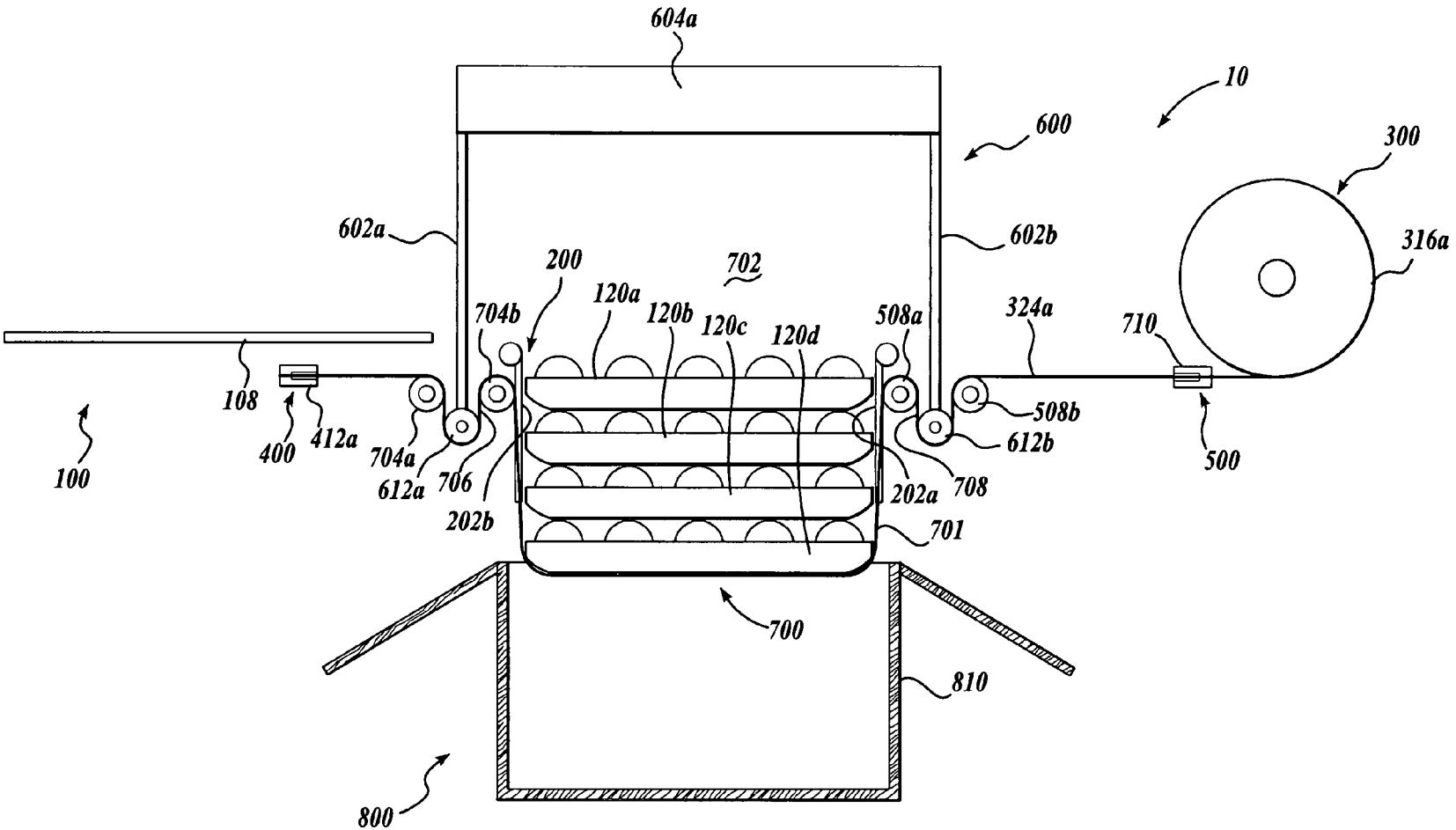
FIG. 23 is a schematic illustration of an apparatus made in accordance with one embodiment of the present invention at a stage of loading an item in a box.

FIG. 23 schematically illustrates the placing of the fourth item 120*d*, thus, completing one stack which is being lowered into the empty box 810. The lowering of the stack into the box 810 is carried out by raising the lowering mechanism 600 and an attendant shortening of the loops 706 and 708 of the sling 701, thereby lowering the stack under the weight from the items 120*a*, 120*b*, 120*c*, and 120*d*. The computer 900 is able to determine when a stack has enough items to constitute a complete stack. Alternatively, trip sensors can indicate when the height of the stack has reached the limit that can fit within the box 810.

Figure 24:
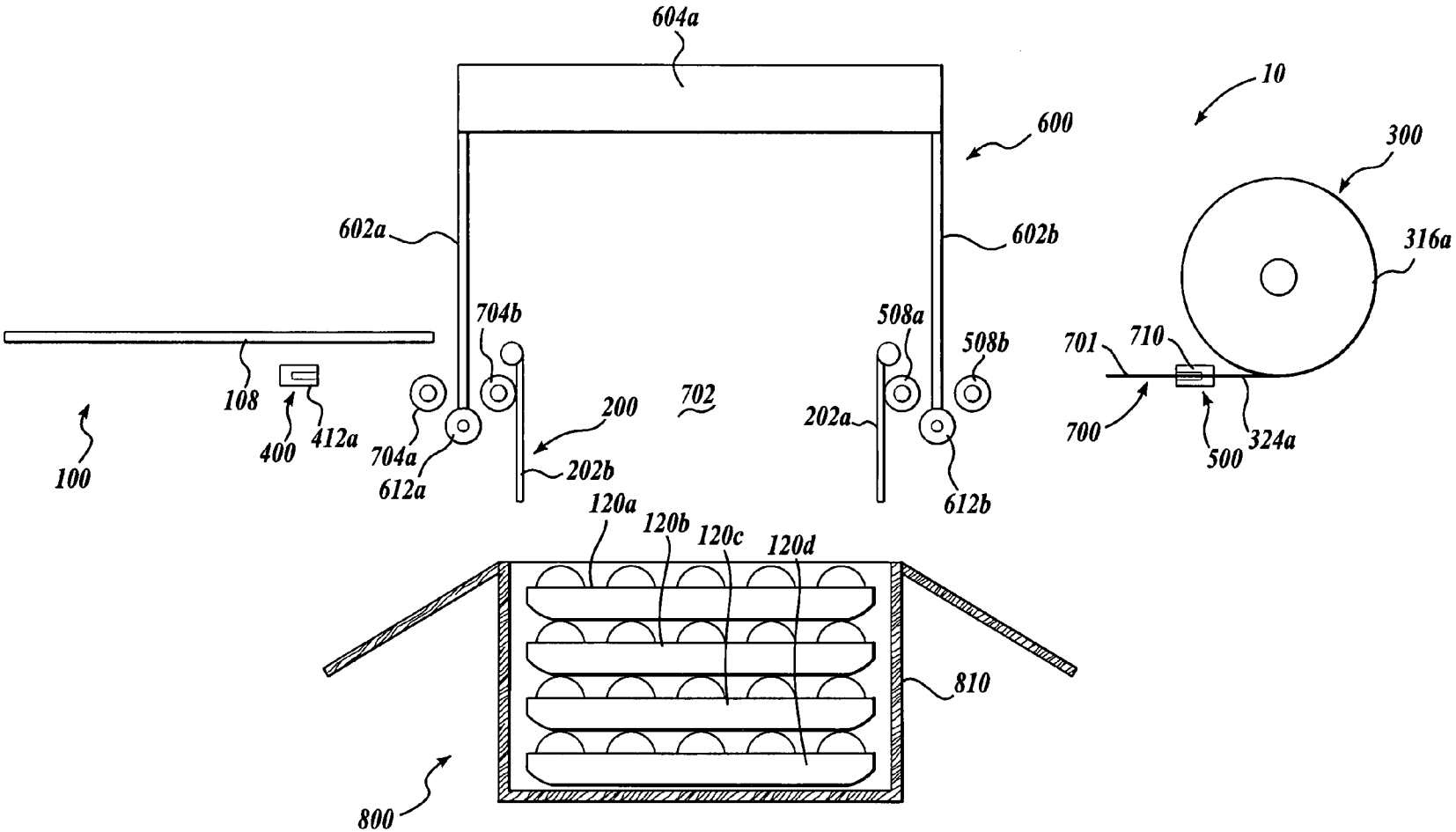
FIG. 24 is a schematic illustration of an apparatus made in accordance with one embodiment of the present invention at a stage of loading an item in a box.

FIG. 24 schematically illustrates the taking up of the strap 324*a*. Prior to such action, however, one end of the sling 701, that is secured by clamp 412*a* of the release mechanism 400 on the forward side of the loading chamber 702, is freed. The sling 701, at the opposite end, is also freed from presser clamp 710, and the take-up mechanism 300 is actuated to wind the strap 324*a* on the winding reel 316*a*. In doing so, the strap 324*a* will be withdrawn from the stationary rollers 704*a* and 704*b*, followed by inside the box 810 and under the stack of items, and finally being pulled up and around the stationary rollers 508*a* and 508*b*. The take-up reel 316*a* will stop when the end of the strap 324*a* is close to disengaging from the cover shield (not shown, but described above). The tortuous path followed by the strap 324*a* when disengaging is accomplished by using a tough, yet flexible material for the strap 324*a*. The filled box 810 can be taken out of alignment with the loading chamber 702 and sent on to a further station where the box 810 can be sealed and/or labeled. Alternatively, a sealing and labeling mechanism (not shown) can be incorporated within the loader 10 so that box closing and sealing can take place within the loader 10.

FIGS. 25-28 illustrate a representative flow diagram of a method 2300 to load items into or onto receptacles in accordance with one embodiment of the present invention. The steps of the method 2300 may be implemented through the computer 900 of FIG. 17.

Method 2300 begins at start block 2302. From start block 2302, the method 2300 enters block 2304. Block 2304 is for setting the lowering mechanism sub-system 600, the release mechanism sub-system 400, and the flap and flipper sub-system 200 to the home position. This means that the lowering mechanism 600 is raised to its upper limit of travel. The release mechanism 400 is shifted to the left or forward of the loading chamber 702, and the flaps 202*a* and 202*b* and the flippers 208 are positioned horizontally. Trip sensors may be used to verify the completion of the actions. Block 2304 is also entered from continuation block 2326, which is entered from continuation block 2372 of FIG. 27, after the completion of one full stacking cycle. From block 2304, the method 2300 enters block 2306.

Block 2306 is for locating the end of the straps 324*a* and 324*b* to a known position. As discussed above, a cover shield 512 is used to straighten the end of the straps 324*a* and 324*b* and to leave a tongue 516 exposed for clamping with the release mechanism 400. From block 2306, the method 2300 enters block 2308.

Block 2308 is for moving the release mechanism 400 to the known position and clamping one end of the straps 324*a* and 324*b* and, thereafter, pulling the straps 324*a* and 324*b* across the loading chamber 702 between two sets of stationary rollers 704*a*, 704*b* and 508*a*, 508*b*, and a similar set of stationary rollers for strap 324*b*. From block 2308, the method 2300 enters decision block 2310.

Decision block 2310 is for determining whether an empty box 810 has been positioned in the correct loading location on the box conveyor 800 and in alignment with the loading chamber 702. Trip sensors may be used to verify the completion of the action. If the determination in decision block 2310 is no, the method 2300 enters block 2312.

Block 2312 is for removing any loaded box from the box loading location. If this is the first iteration through method 2300, there will not be a loaded box in the loading location. From block 2312, the method 2300 enters block 2314.

Block 2314 is for positioning an empty box 810 in the loading location of the box conveyor 800. A trip sensor may be used to verify when the correct placement of an empty box 810 at the appropriate loading location is completed. From block 2314, the method 2300 enters decision block 2310. If the determination in decision block 2310 is yes, the method 2300 enters block 2316.

Block 2316 is for lowering the lowering mechanism 600, such that the moving rollers 612*a*-612*b* and 612*c*, 612*d* pass between and in alignment with the two sets of stationary rollers for each strap 324*a* and 324*b* to form loops in each of two slings 701 another sling which is formed from strap 324*b*. The winding reels 316*a* and 316*b* in the take-up mechanism 300 unwind and pay out additional length of straps 324*a* and 324*b*. From block 2316, the method 2300 enters block 2318.

Block 2318 is for clamping the slings 701, and the other not shown, at the side opposite to the release mechanism 400 and across the loading chamber with presser clamp 710, and another presser clamp not shown, in order to have the slings 701, and the other not shown, clamped at both sides. After clamping the slings at both sides, the slings will maintain their length for the duration of one loading cycle.

From block 2318, the method 2300 enters decision block 2320. Block 2320 is for determining whether an item 120*a* to be loaded has been delivered to the slats 108.

If the determination in decision block 2320 is no, the method 2300 enters continuation block 2324. Continuation block 2324 is an indication to continue on FIG. 28.

Figure 25:
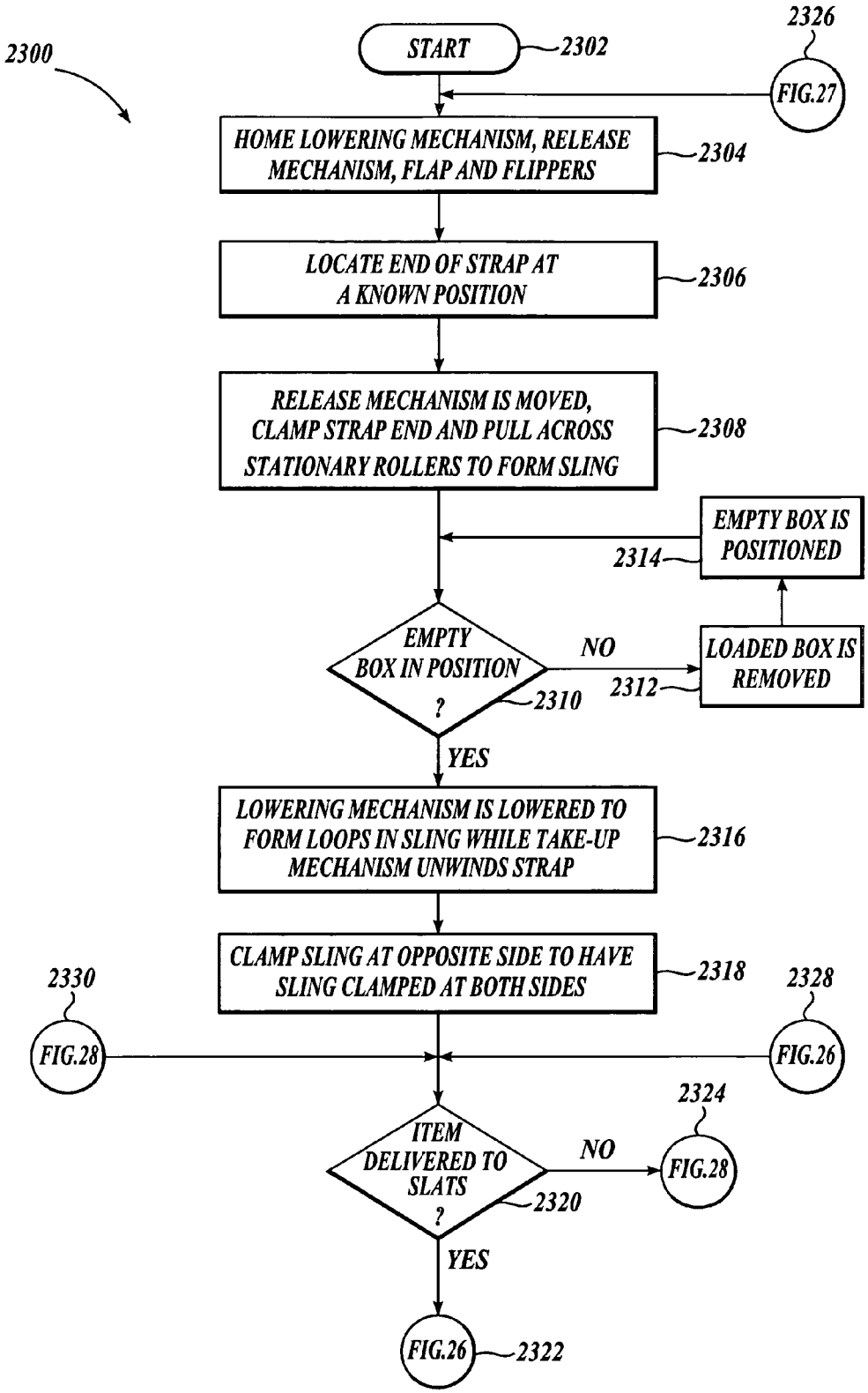
FIG. 25 is a flow diagram of a method for loading an item in a box in accordance with one embodiment of the present invention.
Figure 28:
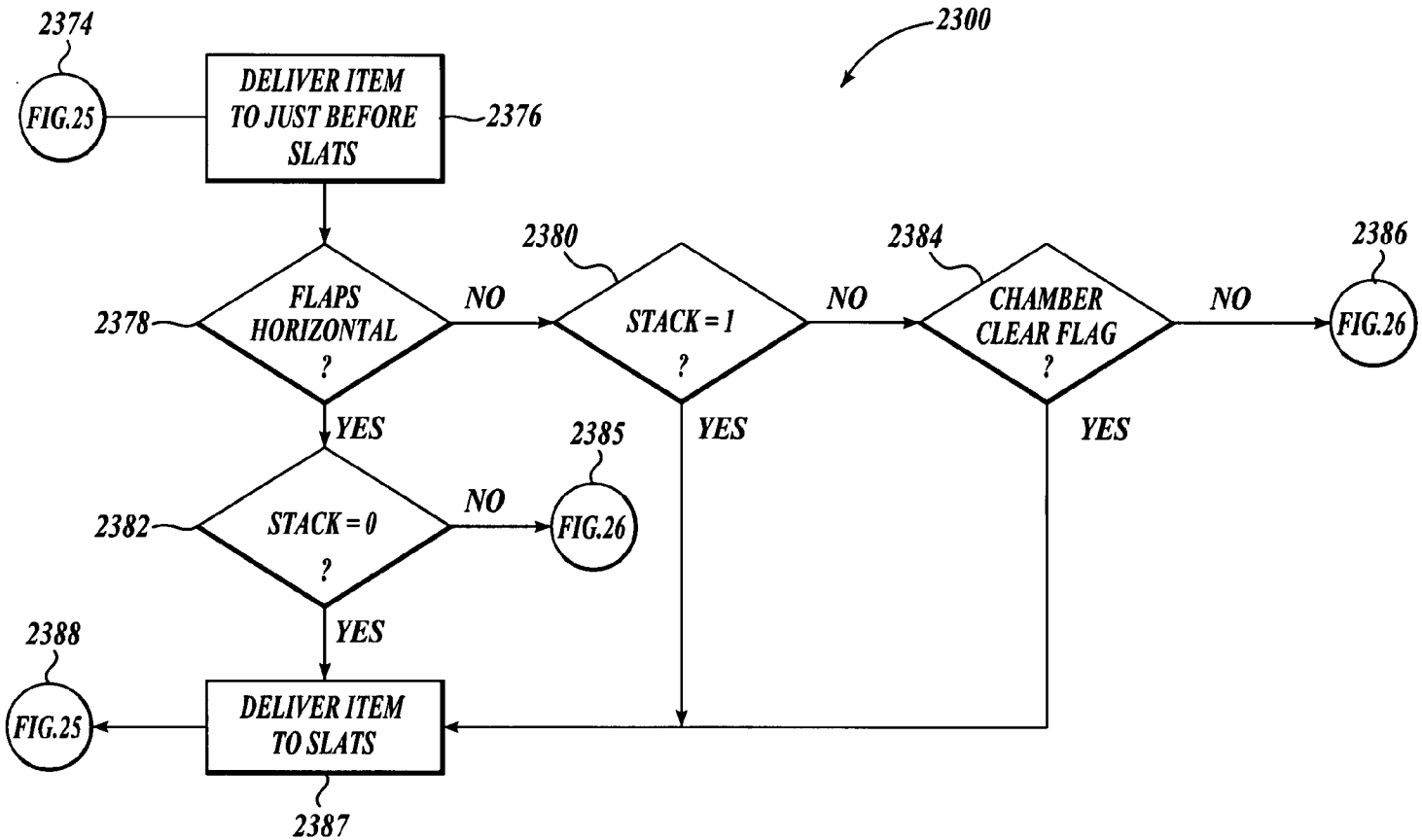
FIG. 28 is a flow diagram of a method for loading an item in a box in accordance with one embodiment of the present invention.

In FIG. 28, continuation block 2374 is entered from continuation block 2324 of FIG. 25. From block 2374, the method 2300 enters block 2376.

Block 2376 is for delivering an item to be loaded to a location on the infeed conveyor 100 just before the slats 108. A trip sensor may be used to determine whether this action is completed. From block 2376, the method 2300 enters decision block 2376.

Decision block 2378 is for determining whether the flaps 202*a* and 202*b* are positioned horizontally. If the determination in decision block 2378 is no, the method 2300 enters decision block 2380.

Decision block 2380 is for determining whether the number of items in the stack is equal to one (1). If the determination in decision block 2380 is no, the method 2300 enters decision block 2384.

Decision block 2384 is for determining whether the chamber clear flag has been set. If the determination in decision block 2384 is no, the method 2300 enters continuation block 2386. Continuation block 2386 is an indication to continue method 2300 on FIG. 26. If the determination in decision block 2384 is yes, the method 2300 enters block 2387.

Block 2387 is for delivering an item to the slats 108. A trip sensor may be used to confirm the completion of the action. When the trip sensor is activated, the item 120*a* can be moved into the loading chamber 702 by actuation of the slats 108, as discussed above. From block 2387, the method 2300 enters continuation block 2388.

Continuation block 2388 is an indication for method 2300 to continue on FIG. 25.

If the determination in decision block 2380 is yes, the method 2300 enters block 2387, and method 2300 proceeds as described above.

If the determination in decision block 2378 is yes, the method 2300 enters decision block 2382.

Decision block 2382 is for determining whether the number of items in the stack is equal to zero (0). If the determination in decision block 2382 is no, the method 2300 enters continuation block 2385.

Figure 26:
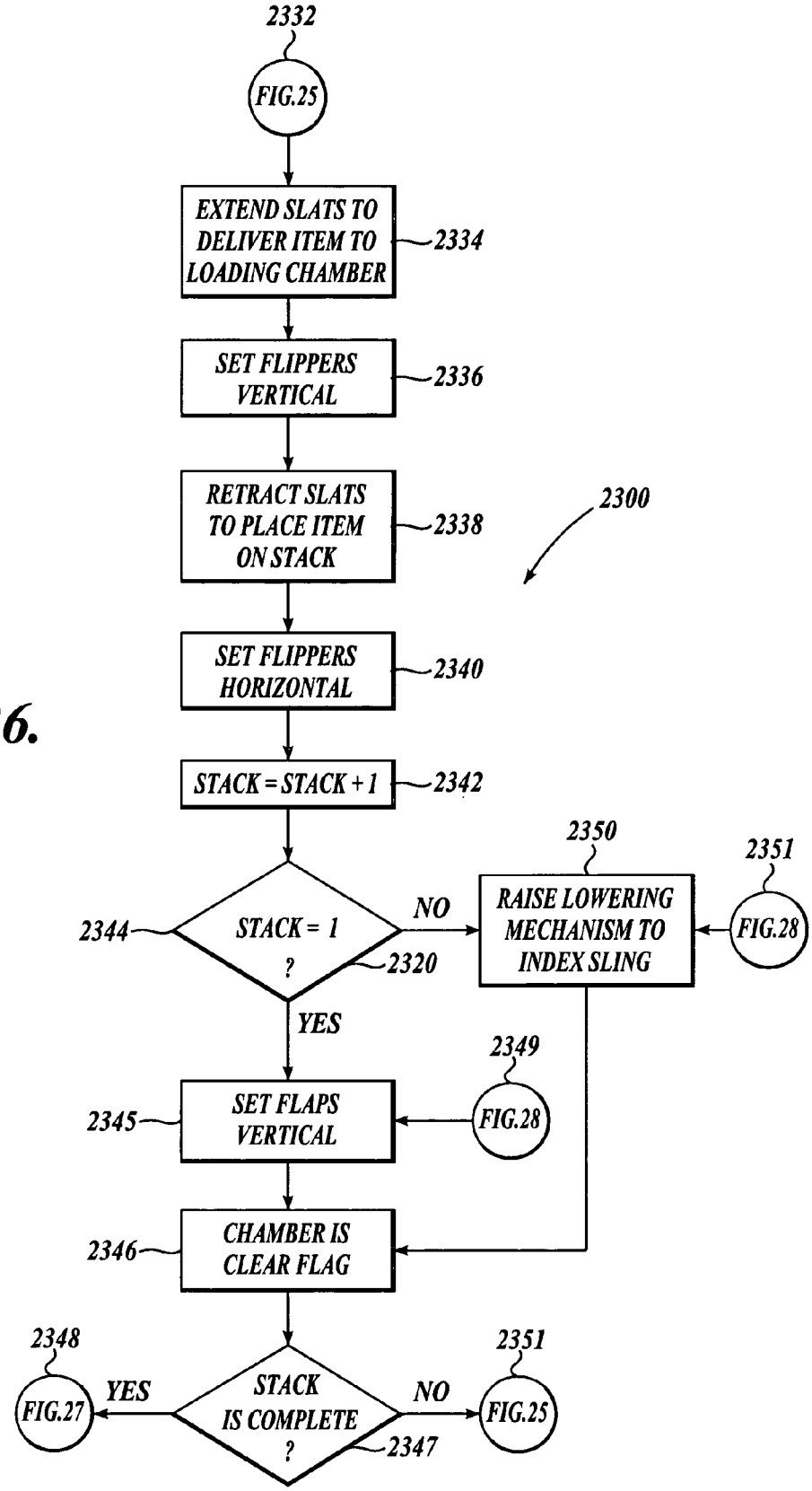
FIG. 26 is a flow diagram of a method for loading an item in a box in accordance with one embodiment of the present invention.

Continuation block 2385 is an indication for method 2300 to continue on FIG. 26.

If the determination in decision block 2382 is yes, the method 2300 enters block 2387, and method 2300 proceeds as described above.

In block 2384, conditions which may cause a chamber clear flag to be set are one of the following: (1) the flaps 202*a* and 202*b* are in the horizontal position and the item 120*a* is the first item of the stack, or (2) the flaps 202*a* and 202*b* are in the vertical position and the item 120*b* is the second item from the bottom of the stack, or (3) the flaps 202*a* and 202*b* are in the vertical position and the item 120*c* is the third or greater item 120*c* or 120*d* in the stack, and the lowering mechanism 600 has indexed to lower the sling 701 downward sufficiently to provide clearance for the next item. This means that the second item 120*b* can be placed atop the first item 120*a* without indexing of the lowering mechanism 600.

In FIG. 25, the continuation block 2330 is entered from continuation block 2388 of FIG. 28, and the continuation block 2328 is entered from the continuation block 2351 of FIG. 26. From continuation block 2330 and continuation block 2328, the method 2300 enters decision block 2320. If the determination in decision block 2320 is yes, the method 2300 enters continuation block 2322. Continuation block

2322 is an indication for method 2300 to continue on FIG. 26 with continuation block 2332.

In FIG. 26, continuation block 2332 is entered from continuation block 2322 of FIG. 25. From continuation block 2332, the method 2300 enters block 2334.

Block 2334 is for extending the slats 108 to deliver the item 120*a* to the loading chamber 702. A trip sensor may determine when the item 120*a* has been delivered to the loading chamber 702. From block 2334, the method 2300 enters block 2336.

Block 2336 is for raising the back end set of flippers 212 to the vertical position. The back end set of flippers 212 prevent the item 120*a* from shifting out of alignment with the loading chamber 702 when the slats 108 are retracted. Block 2336 is also used for extending the support ledge 216 to the engagement position as shown in FIG. 6, simultaneously with or sequentially when the set of flippers 212 is raised vertically. From block 2336, the method 2300 enters block 2338.

Block 2338 is for retracting the slats 108 to place the item 120*a* onto the flaps 202*a* and 202*b*. Both set of slippers 212 and support ledge 216 provide guides to guide the item 120*a* to drop smoothly and in alignment onto flaps 202*a* and 202*b*. From block 2338, the method 2300 enters block 2340.

Block 2340 is for lowering the back end set of flippers 212 to the horizontal position to allow a second item 120*b* to be stacked on top of the first item 120*a* in the stack. The placement of the first item 120*a* on the flaps 202*a* and 202*b* allows enough room for placement of a second item 120*b* without indexing the lowering mechanism 600. From block 2340, the method 2300 enters block 2342.

Block 2342 keeps count of the number of items in the stack by adding the integer 1 (one) to the previous counter. From block 2342, the method 2300 enters decision block 2344.

Decision block 2344 makes a determination whether the number of items 120*a* in the stack is equal to one (1). If the determination in decision block 2344 is no, the method 2300 enters block 2350. Block 2350 is also entered from continuation block 2351, which is entered from continuation block 2386 of FIG. 28.

Block 2350 is for indexing the lowering mechanism 600 upwards, thereby shortening the loops 706 and 708 on both sides of the sling 701, and the other loops of the sling that are not shown. The excess length results in a lowering of the portion of the slings 701, and the other that is not shown, that is weighted down with the items. A trip sensor may be used to determine when the slings have been lowered sufficiently. From block 2350, the method 2300 enters block 2346. If the determination in decision block 2344 is yes, meaning one item on the stack, the method 2300 enters block 2345.

Block 2345 is for setting the flaps 202*a* and 202*b* to the vertical position. Block 2345 is also entered from continuation block 2349, which is entered from continuation block 2385 of FIG. 28. From block 2345, the method 2300 enters block 2346.

Block 2346 is for setting a flag that the loading chamber 702 is now clear to receive an additional item. From block 2346, the method 2300 enters decision block 2347.

Decision block 2347 is for determining whether the stack is completed, meaning that no further items are to be loaded on the stack. If the determination in decision block 2347 is no, the method 2300 enters continuation block 2354. Continuation block 2354 is an indication to continue method 2300 at continuation block 2328 of FIG. 25. If the determination in decision block 2347 is yes, the method 2300 enters continuation block 2348. Continuation block 2348 is an indication to continue method 2300 at continuation block 2356 of FIG. 27.

Figure 27:
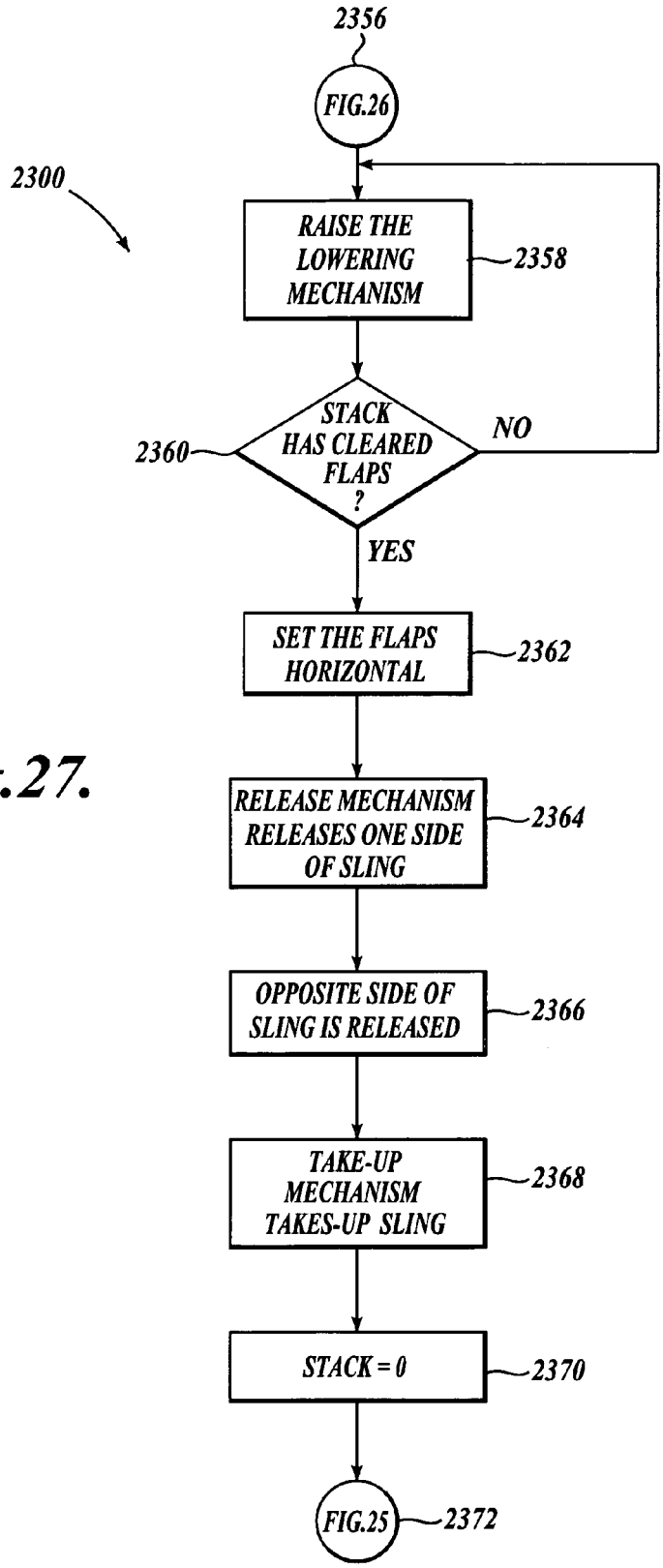
FIG. 27 is a flow diagram of a method for loading an item in a box in accordance with one embodiment of the present invention.

In FIG. 27, continuation block 2356 is entered from continuation block 2348 of FIG. 26. From block 2356, the method 2300 enters block 2358.

Block 2358 is for raising the lowering mechanism 600. The lowering mechanism 600 is raised after completion of a full stack of items is completed. From block 2358, the method 2300 enters decision block 2360.

Decision block 2360 is for determining whether the stack has cleared the flaps 202*a* and 202*b*, meaning that the stack has been lowered enough so that the flaps 202*a* and 202*b* can be raised horizontally without interference. If the determination in decision block 2360 is no, the method 2300 returns to block 2358 and continues raising the lowering mechanism 600. A trip sensor can indicate when the stack has cleared the flaps 202*a* and 202*b* or, alternatively, when the lowering mechanism has risen to the upper limit of travel. If the determination in decision block 2360 is yes, the method 2300 enters block 2362.

Block 2362 is for raising the flaps 202*a* and 202*b* to the horizontal position in preparation for a new stacking cycle. From block 2362, the method 2300 enters block 2364.

Block 2364 is for releasing one side of the slings 701, and the other sling that is not shown, at the release mechanism 400 side of the loading chamber 702. The slings 701, and the other sling that is not shown, are preferably made from a flexible, thin, but durable material, such as nylon webbing, to allow small clearances between the box 810 and the items 120*a*, 120*b*, 120*c*, and 120*d*. Furthermore, items, such as tray 120*a*, can be manufactured having grooves at the lower and side surfaces, wherein the slings 701, and the other sling that is not shown, seat at the grooves provided at lower and possibly the side surfaces to conceal the slings. The grooves, therefore, can provide standing legs on either side of the slings 701, and the other sling that is not shown, so that the weight of the stack rests on the legs rather than the slings, so that withdrawing the slings from the bottom of the stack is made easier. From block 2364, the method 2300 enters block 2366.

Block 2366 is for unclamping the opposite side of the slings 701, and the other sling that is not shown, that is opposite to the release mechanism 400 and across the loading chamber 702 in preparation for taking up the slings 701, and the other sling that is not shown. It is possible that both release actions described in blocks 2364 and 2366 can occur simultaneously. From block 2366, the method 2300 enters block 2368.

Block 2368 is for taking up the slings 701, and the other sling that is not shown, with the take-up mechanism 300. The air motor 302 is actuated, causing the winding reels 316*a* and 316*b* to rotate and wind the straps 324*a* and 324*b* onto the winding reels 316*a* and 316*b*. From block 2368, the method 2300 enters block 2370.

Block 2370 is for initializing the counter of items in a stack to zero (0) in preparation for the start of a new stacking cycle. From block 2370, the method 2300 enters continuation block 2372. Block 2372 indicates that the method 2300 is continued on continuation block 2326 of FIG. 25.

In FIG. 25, continuation block 2326 is entered from continuation block 2372 of FIG. 27. From block 2326, the method 2300 enters block 2304, and the method 2300 can begin a new cycle of stacking items.

Although, one representative method has been illustrated and described, it is possible to configure other methods where steps may be performed sequentially or simultaneously. For example, one or more steps of the method 2300 can be performed simultaneously, where possible, to increase the loading capacity of the loader 10 per unit time. Additionally, actuator arms can have multiple attachments to more than one component so as to actuate two components with a single actuator body. This is beneficial, for example, when actions need to be synchronized.

While illustrative embodiments have been illustrated and described, it will be appreciated that various changes can be made therein without departing from the spirit and scope of the invention.

The embodiments of the invention in which an exclusive property or privilege is claimed are defined as follows:

1. A loader, comprising:

(a) a sling;

(b) a lowering mechanism in contact with the sling that can lower the sling;

(c) a release mechanism that secures at least one side of the sling; and (d) a take-up mechanism attached to the sling on the side opposite from the release mechanism;

wherein the sling is formed from a strap, one end of the strap is clamped, the strap passes over a first and a second set of stationary rollers, each set having a first and a second roller, and the lowering mechanism creates a loop between each first and second roller of each set of stationary rollers.

2. A loader, comprising:

(a) a sling;

(b) a lowering mechanism in contact with the sling that can lower the sling;

(c) a release mechanism that secures at least one side of the sling; and (d) a take-up mechanism attached to the sling on the side opposite from the release mechanism;

wherein the sling is formed from a strap that spans a loading chamber, the strap is secured on both sides of the loading chamber, the strap passes over a first and a second set of stationary rollers, each set having a first and a second roller, and a moving roller engages the strap between the first and the second stationary roller of each set.

3. A loader, comprising:

(a) a sling;

(b) a lowering mechanism in contact with the sling that can lower the sling;

(c) a release mechanism that secures at least one side of the sling; and (d) a take-up mechanism attached to the sling on the side opposite from the release mechanism;

wherein the lowering mechanism comprises a frame having vertical corner beams, wherein a moving roller is connected at the lower end of each vertical corner beam.

4. A loader, comprising:

(a) a sling;

(b) a lowering mechanism in contact with the sling that can lower the sling;

(c) a release mechanism that secures at least one side of the sling; and (d) a take-up mechanism attached to the sling on the side opposite from the release mechanism;

wherein the loader further comprises an infeed conveyor comprising a series of bands which can be actuated to rise above the level of slats, and the slats can be translated linearly to deliver an item to the sling.

5. A loader, comprising:

(a) a sling;

(b) a lowering mechanism in contact with the sling that can lower the sling;

(c) a release mechanism that secures at least one side of the sling; and (d) a take-up mechanism attached to the sling on the side opposite from the release mechanism;

wherein the loader further comprises a box conveyor comprising a set of front and rear box stoppers which act in unison to remove a loaded box and locate an empty box at a loading location.

6. A loader, comprising:

(a) a sling;

(b) a lowering mechanism in contact with the sling that can lower the sling;

(c) a release mechanism that secures at least one side of the sling;

(d) a take-up mechanism attached to the sling on the side opposite from the release mechanism; and (e) a first and a second flap, wherein the flaps are actuatable from the horizontal position to a vertical position to place an item on the sling.

7. A loader, comprising:

(a) a sling;

(b) a lowering mechanism in contact with the sling that can lower the sling;

(c) a release mechanism that secures at least one side of the sling;

(d) a take-up mechanism attached to the sling on the side opposite from the release mechanism; and (e) a set of flippers that are actuatable from a horizontal position to a vertical position.

8. A loader, comprising:

(a) a sling;

(b) a lowering mechanism in contact with the sling that can lower the sling;

(c) a release mechanism that secures at least one side of the sling;

(d) a take-up mechanism attached to the sling on the side opposite from the release mechanism; and (e) a computer system having software modules for performing a method comprising:

(i) locating the end of a strap at a predetermined location;

(ii) grasping the end of the strap with the release mechanism;

(iii) pulling the strap to pay out the strap from the take-up mechanism, and carry the strap across a first and a second set of stationary rollers, wherein each set of stationary rollers includes a first and a second roller;

(iv) lowering the lowering mechanism while paying out the strap from the take-up mechanism to pass a moving roller between the first and second roller of each set of stationary rollers to create a first and a second loop in the strap; and (v) securing both sides of the strap ahead and behind of the first and the second set of stationary rollers to form the sling.

9. The loader of claim 8, wherein the method further comprises, carrying an item to a loading chamber, raising a set of flippers, and placing the item on a first and a second flap.

10. The loader of claim 9, wherein the method further comprises, moving the first and the second flap to a vertical position to place the item on the sling.

11. The loader of claim 10, wherein the method further comprises, raising the lowering mechanism to shorten the first and the second loops and lowering the sling.

12. The loader of claim 11, wherein the method further comprises, placing an item on top of a previous item, followed by raising the lowering mechanism to lower the sling.

13. The loader of claim 12, wherein the method further comprises, releasing one side of the sling, taking up the sling from the opposite side to place the items into or onto a receptacle.

14. A loader, comprising:

(a) a sling;

(b) means for lowering the sling;

(c) a release mechanism that secures at least one side of the sling; and (d) a take-up mechanism attached to the sling on the side opposite from the release mechanism.

15. The loader of claim 14, wherein the means for lowering the sling include a frame comprising vertical corner beams having a moving roller at the bottom of the vertical corner beams, and a lead screw that engages the frame.

16. The loader of claim 14, wherein the means for lowering the sling include a means that pays out length of sling to lower the part of the sling being weighted down by one or more items being carried by the sling.

17. The loader of claim 14, wherein the means for lowering the sling comprises a first loop formed on a first side of the sling and a second loop formed on a second side of the sling.

18. The loader of claim 14, wherein the means for lowering the sling comprises a first loop formed on a first side of the sling between a first and a second stationary roller and a second loop formed on a second side of the sling between a first and a second stationary roller, and a moving roller engaged with the sling at the bottom of the first loop and the second loop.

* * * * *